US009676586B2

(12) United States Patent
Cheich et al.

(10) Patent No.: US 9,676,586 B2
(45) Date of Patent: Jun. 13, 2017

(54) REDUCED FOOTPRINT DUNNAGE CONVERSION SYSTEM AND METHOD

(75) Inventors: Robert C. Cheich, Independence, OH (US); David V. Murphy, Painesville, OH (US); Richard L. Gwynne, Stow, OH (US); Steven M. Toneff, Painesville, OH (US)

(73) Assignee: Ranpak Corp., Concord Township, OH (US)

( * ) Notice: Subject to any disclaimer, the term of this patent is extended or adjusted under 35 U.S.C. 154(b) by 702 days.

(21) Appl. No.: 14/124,967

(22) PCT Filed: Jun. 6, 2012

(86) PCT No.: PCT/US2012/041014

§ 371 (c)(1),
(2), (4) Date: Feb. 19, 2014

(87) PCT Pub. No.: WO2012/170474

PCT Pub. Date: Dec. 13, 2012

(65) Prior Publication Data

US 2014/0155241 A1 Jun. 5, 2014

Related U.S. Application Data

(60) Provisional application No. 61/494,033, filed on Jun. 7, 2011, provisional application No. 61/570,335, filed on Dec. 14, 2011.

(51) Int. Cl.
*B65H 45/04* (2006.01)
*B31D 5/00* (2017.01)

(52) U.S. Cl.
CPC ..... *B65H 45/04* (2013.01); *B31D 5/0043* (2013.01); *B31D 2205/0035* (2013.01)

(58) Field of Classification Search
CPC ..... B31D 2205/0035; B31D 5/0043; B65H 45/04
USPC ..... 493/350, 405, 407, 408, 464, 967; 206/814; 53/121
See application file for complete search history.

(56) References Cited

U.S. PATENT DOCUMENTS 3,692,304 A * 9/1972 de Ridder ..... B65H 29/14 271/188
4,395,034 A * 7/1983 Fukui ..... B65H 1/04 271/21
5,092,573 A * 3/1992 Abreu ..... B65H 21/00 156/502
5,692,999 A * 12/1997 Crowley ..... B62B 1/10 108/1

(Continued)

OTHER PUBLICATIONS

International Preliminary Report on Patentability dated Dec. 27, 2013 for PCT/US2012/041014.

(Continued)

*Primary Examiner* — Hemant M Desai
*Assistant Examiner* — Valentin Neacsu
(74) *Attorney, Agent, or Firm* — Renner, Otto, Boisselle & Sklar, LLP

(57) ABSTRACT

A method of converting a supply of sheet stock into a relatively less dense dunnage product, including the following steps of (i) providing a stack of fan-folded sheet material having fold lines parallel to a width dimension; and (ii) drawing sheet stock material from the stack in a direction parallel to the width dimension.

20 Claims, 21 Drawing Sheets

(56) References Cited

U.S. PATENT DOCUMENTS

| | | | | |
|---|---|---|---|---|
| 6,918,489 | B2 * | 7/2005 | Harding | B31D 5/0047 206/451 |
| 2002/0091053 | A1 * | 7/2002 | Kung | B31D 5/0047 493/350 |
| 2004/0142806 | A1 * | 7/2004 | Coppus | B31D 5/0047 493/350 |
| 2005/0040588 | A1 * | 2/2005 | Chang | B65H 1/14 271/126 |
| 2005/0181924 | A1 * | 8/2005 | Demers | B26F 3/02 493/350 |
| 2008/0098699 | A1 * | 5/2008 | Cheich | B31D 5/0047 53/472 |
| 2008/0153685 | A1 * | 6/2008 | Cheich | B31D 5/0047 493/381 |
| 2009/0075800 | A1 * | 3/2009 | Wetsch | B31D 5/006 493/464 |
| 2009/0082187 | A1 * | 3/2009 | Cheich | B31D 5/0047 493/350 |
| 2009/0286437 | A1 * | 11/2009 | Cunningham | A47L 13/17 442/61 |
| 2011/0053751 | A1 * | 3/2011 | Arora | B31D 5/0047 493/464 |
| 2011/0111940 | A1 * | 5/2011 | Carlson | B31D 5/0047 493/405 |

OTHER PUBLICATIONS

International Search Report and Written Opinion for WO 2012/170474 A1.

* cited by examiner

REDUCED FOOTPRINT DUNNAGE CONVERSION SYSTEM AND METHOD

This application claims the benefit of U.S. Provisional Patent Application No. 61/494,033, filed Jun. 7, 2011, and U.S. Provisional Patent Application No. 61/570,335, filed Dec. 14, 2011, which are incorporated herein by reference.

FIELD OF THE INVENTION

This invention relates generally to a dunnage conversion system and method for converting a sheet stock material into a dunnage product, and more particularly to a more compact dunnage conversion system and method.

BACKGROUND

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. By filling the void volume, the dunnage prevents or minimizes movement of the articles that might lead to damage during the shipment process. The dunnage also can perform blocking, bracing, or cushioning functions. Some commonly used dunnage materials are plastic foam peanuts, plastic bubble pack, air bags and converted paper dunnage material.

A supply of dunnage material can be provided to the packer in advance, or the dunnage material can be produced as it is needed. Low volume applications typically have used dunnage materials such as plastic foam peanuts and manually-crumpled newspaper. Plastic foam peanuts are messy and occupy the same volume when being stored as when being used. Crumpled newspaper also is messy and requires the packer to manually crumple the newspaper. Alternatively, a dunnage conversion machine can be used to convert a supply of stock material, such as a roll or stack of paper, into a lower density dunnage product as it is needed by the packer. For example, U.S. Pat. No. 6,676,589 discloses a dunnage conversion machine that converts a continuous sheet of paper into a crumpled dunnage product.

SUMMARY OF THE INVENTION

A disadvantage of some conversion machines is their width or the amount of space that they occupy, and in some situations it would be desirable to provide a narrower converter and a correspondingly narrow supply of stock material. Wider sheet material, however, can provide a higher density dunnage product that is more desirable in certain packing situations.

The present invention provides a method of using an existing stack of fan-folded sheet stock material that effectively reduces the width of the stock material as it is drawn from the stack. The conventional practice of drawing fan-folded sheet stock material from a stack includes pulling the sheet in a direction perpendicular to the widthwise-extending fold lines. In the present invention, however, the stock material is withdrawn from the stack in a direction parallel to the width dimension, where fold lines in the stack also extend along the width direction, rather than parallel to the length dimension and transverse the width dimension, as is the conventional practice. Due to the attachment of successive sheets along the fold lines, the sheets deform from their planar state and crumple as they are drawn from the stack.

This also reduces or eliminates the need to form the sheet material before it is pulled into the feed mechanism in the converter, thereby enabling simpler and smaller dunnage converters.

More particularly, the present invention provides a method of converting a supply of sheet stock into a relatively less dense dunnage product. The method includes the following steps: (i) providing a stack of fan-folded sheet material having fold lines generally extending in a direction parallel to a width dimension, and (ii) drawing sheet stock material from the stack in a direction generally parallel to the width dimension or in a direction parallel to the fold line.

In one or more embodiments of the invention, the method includes one or more of the following steps: (a) the drawing step is accomplished by one or more rotating members in a conversion machine, and (b) the drawing step includes drawing sheet stock material from a top of the stack.

The presented invention also provides an apparatus for converting a supply of sheet stock material into a relatively less dense dunnage product, the supply including a stack of fan-folded sheet stock material having a width dimension and fold lines generally parallel to the width dimension; the apparatus comprising a housing enclosing a feed mechanism, and a support for a supply of sheet stock material upstream of housing to support a stack of fan-folded sheet stock material with the width dimension being aligned with a downstream direction through the housing.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

FIG. 24 is an enlarged view of section 24 of FIG. 23.

DETAILED DESCRIPTION

Figure 3:
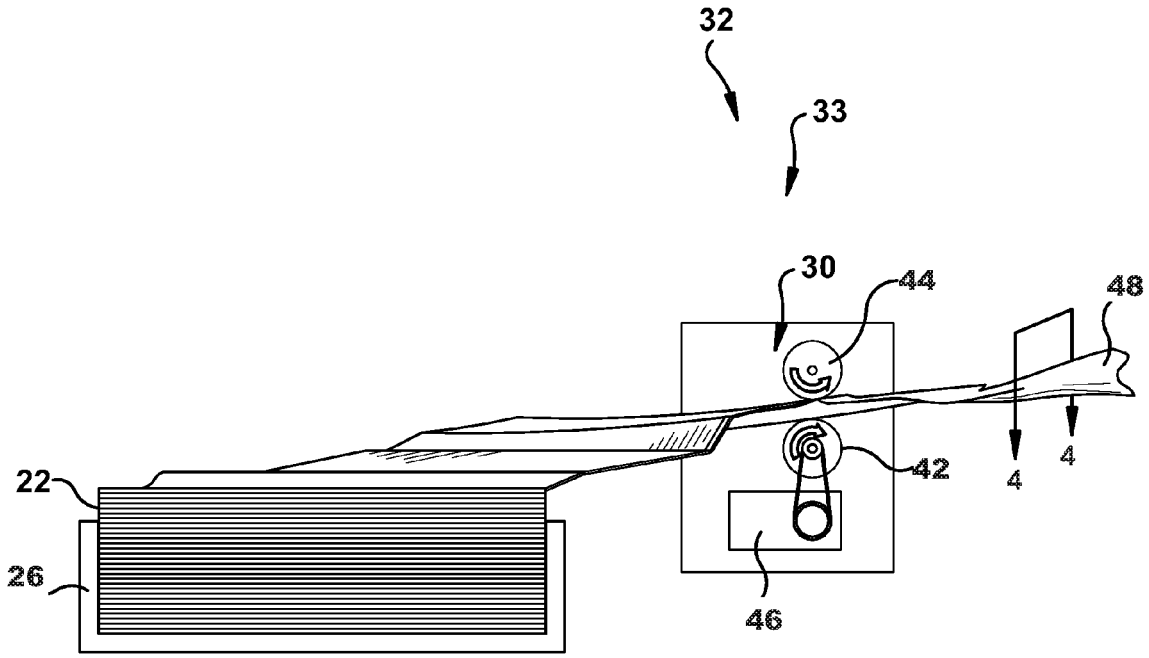
FIG. 3 is a schematic view of a dunnage conversion system provided by the present invention, including the stack of sheet stock material of FIG. 2 and a schematic dunnage conversion machine.
Figure 4:
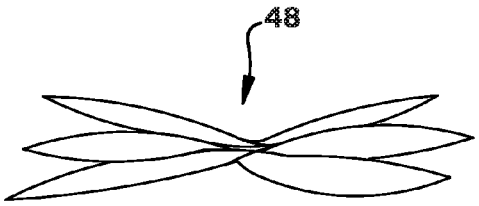
FIG. 4 is a cross-sectional view of a dunnage product provided by the present invention, as seen along lines 4-4 in FIG. 3.
Figure 5:
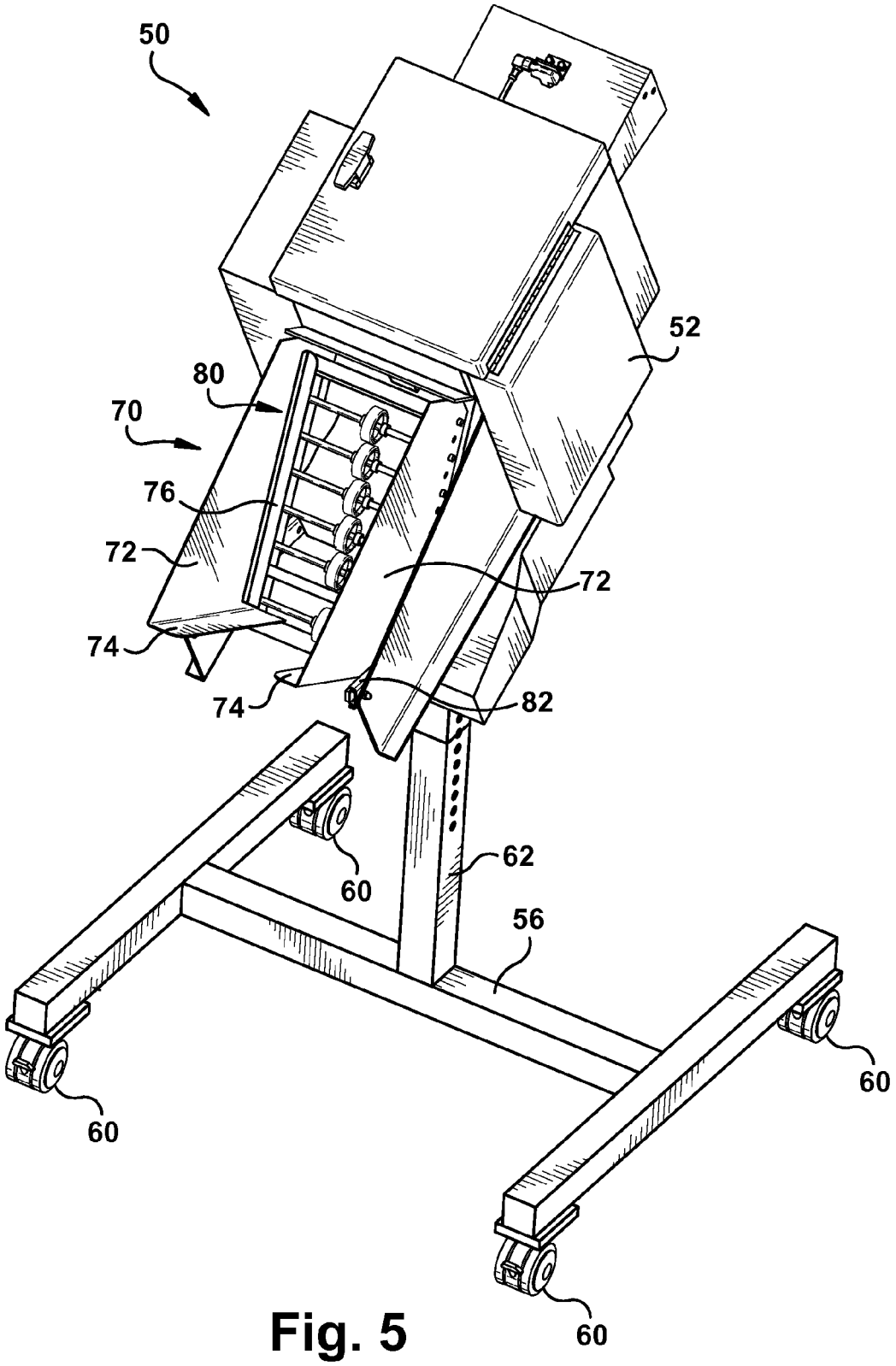
FIG. 5 is a perspective view of an exemplary dunnage conversion machine provided by the present invention.
Figure 6:
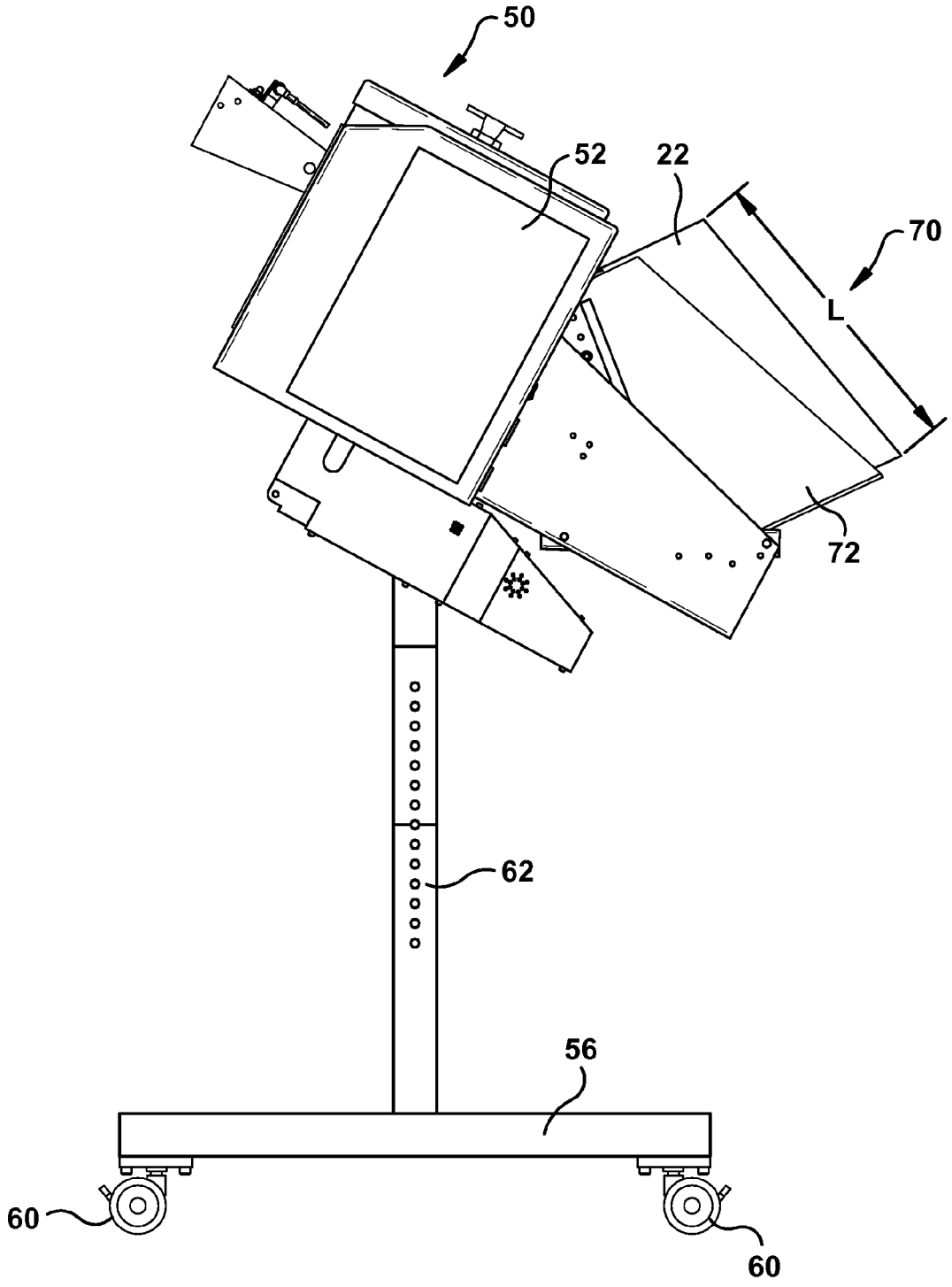
FIG. 6 is a side elevation view of the dunnage conversion machine of FIG. 5 with a supply of fan-folded sheet stock material.
Figure 7:
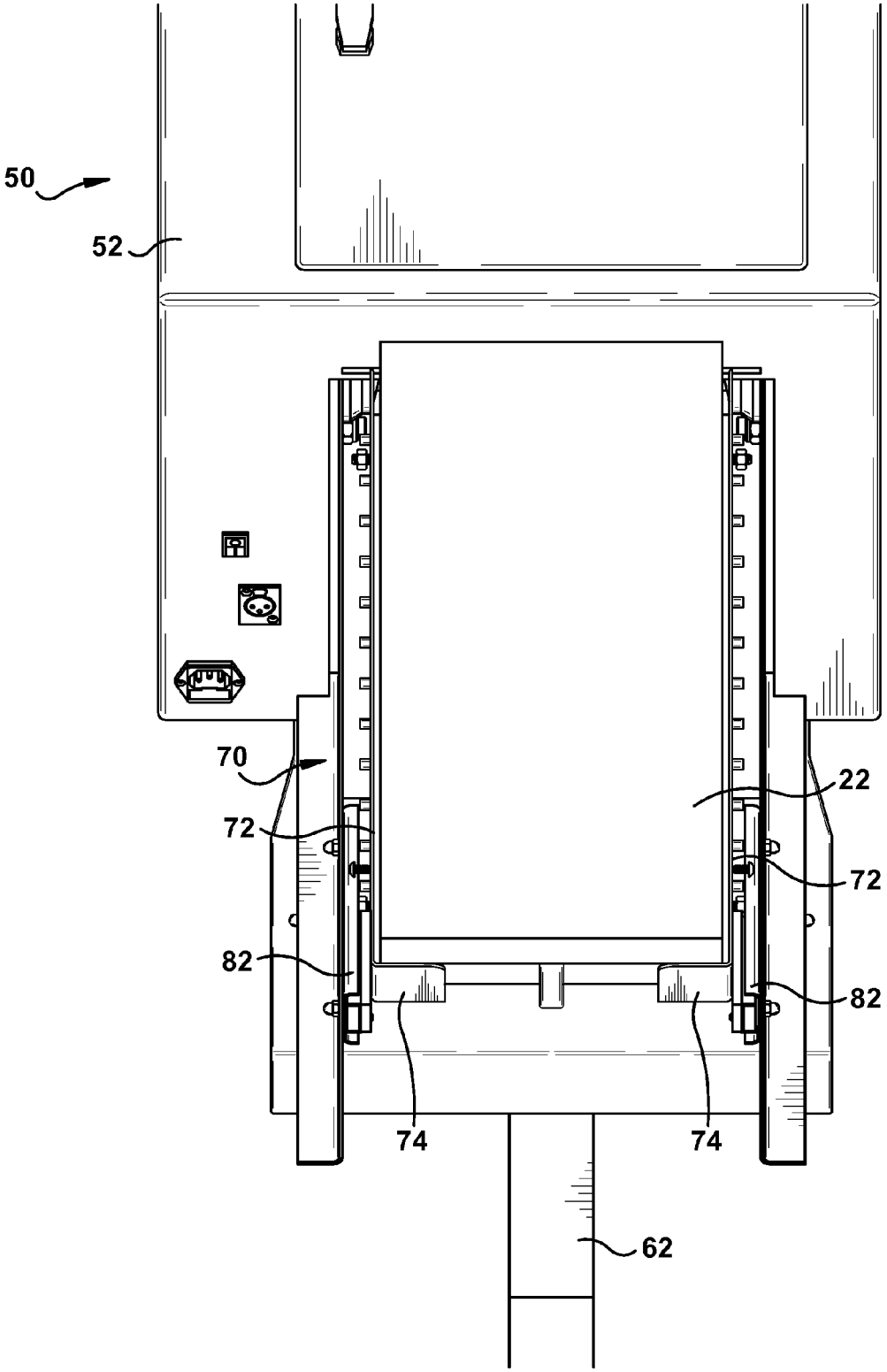
FIG. 7 is an enlarged view of a portion of the dunnage conversion machine of FIG. 6.
Figure 8:
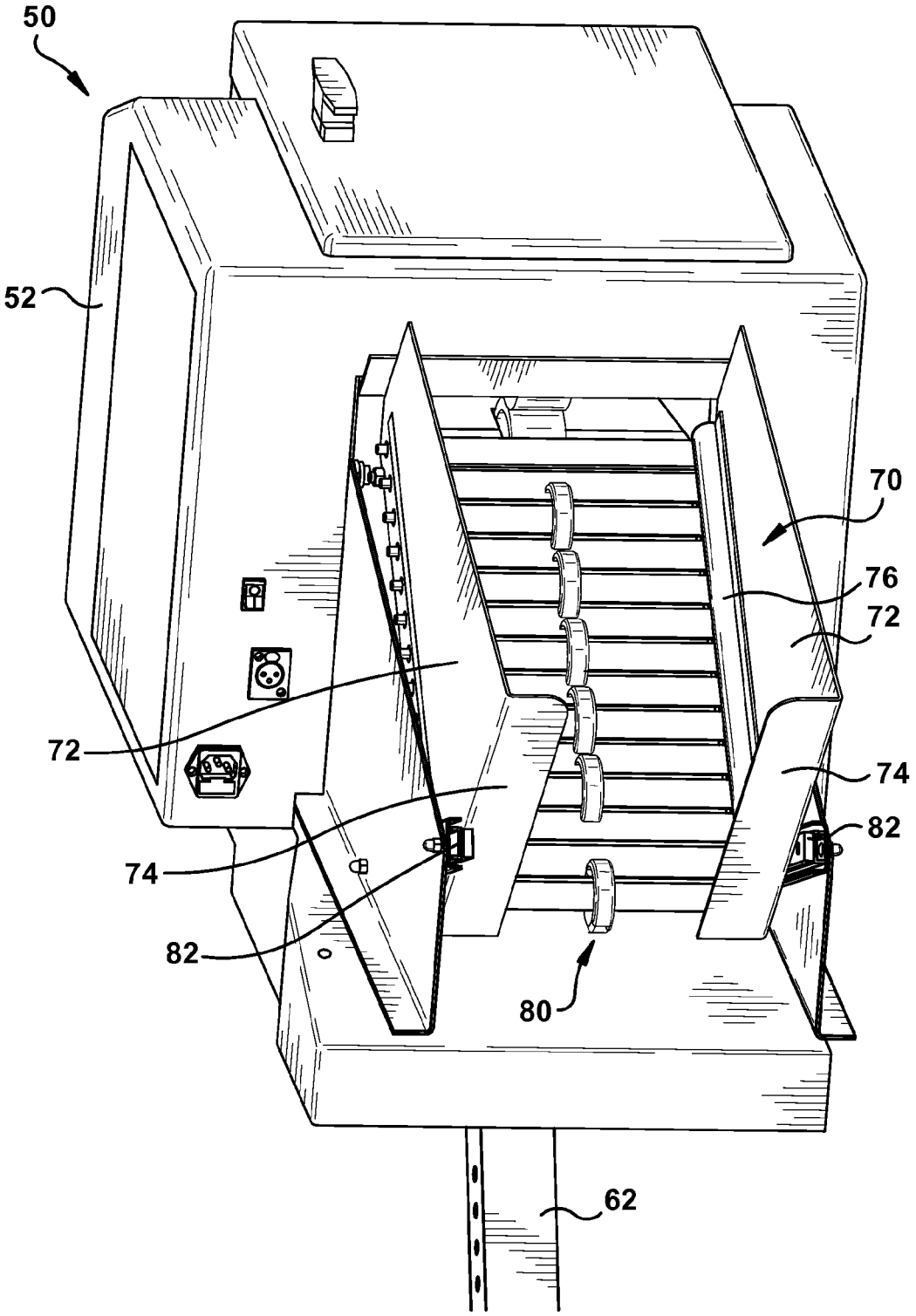
FIG. 8 is a perspective view of the dunnage conversion machine of FIG. 5 without the sheet stock material.
Figure 9:
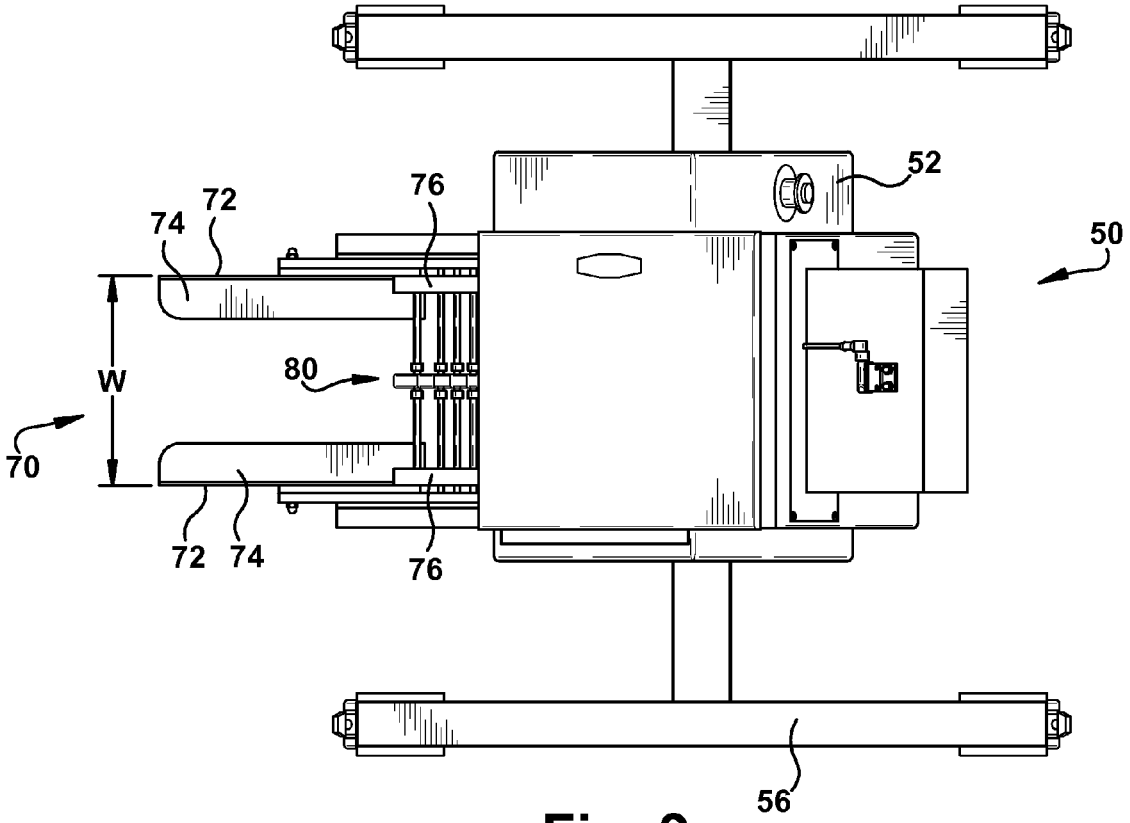
FIG. 9 is a top view of the dunnage conversion machine of FIG. 8.

Referring now to the drawings, the present invention provides a supply 20 (FIG. 1) of sheet stock material 22 (FIG. 1) for conversion into a relatively less-dense dunnage product 48 (FIG. 4). The supply 20 includes a stack 22 of fan-folded sheet stock material and a cartridge or container 26 for receiving the stack 22. The supply 20 provides a relatively wide sheet stock material 22 within a narrower footprint, reducing or eliminating the need to form the sheet material before it is pulled into a feed mechanism 30 (FIG. 3) in a dunnage conversion machine 32 (FIG. 3).

The stack 22 preferably includes one or more plies of sheet stock material, such as paper, and more particularly kraft paper. The stack 22 has a width dimension W, a depth dimension D, and a height dimension H. The sheet stock material 22 also has fold lines 34 generally parallel to the width dimension W. The stock material also preferably is perforated or otherwise weakened along longitudinally-spaced, transversely-extending tear lines 36 to enable and/or facilitate separating discrete sections of dunnage from the crumpled strip. The tear lines generally are coextensive with the fold lines 34.

In prior dunnage conversion systems, the sheet stock material is drawn from the stack in a direction generally perpendicular to the width dimension of the stock material, which generally corresponds to the width of the stack. Successive sheets in the stack are connected together along fold lines that also extend along the width dimension. Dunnage conversion machines that convert a supply of such stock material into a dunnage product generally have a width that is similar to the width of the stock material. Consequently, some existing dunnage conversion machines can take up a significant amount of floor space.

The present invention provides a way to reduce the width of a dunnage conversion machine, by drawing the sheet stock material from the stack in a direction generally parallel to the width dimension. In other words, the present invention provides a method of converting a supply of sheet stock into a relatively less dense dunnage product by drawing sheet stock material from the stack in a direction parallel to the width dimension and the fold lines.

Figure 2:
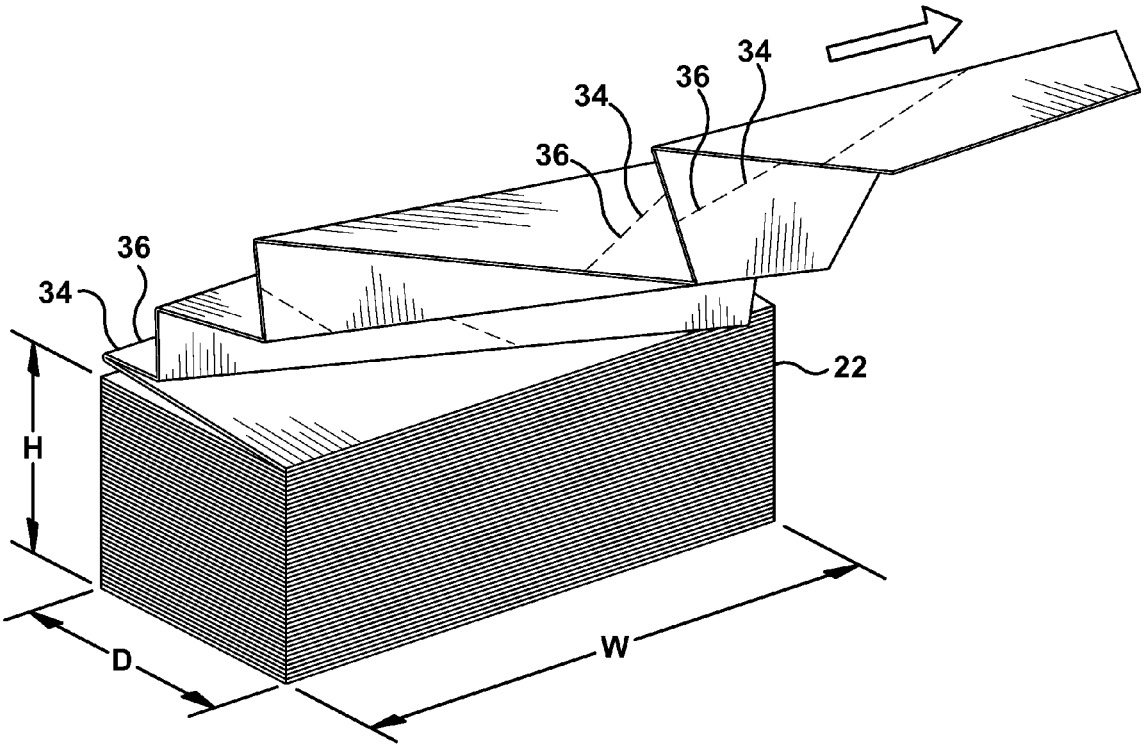
FIG. 2 is a perspective view of the stack of sheet stock material of FIG. 1 illustrating another aspect of the invention.

As shown in FIG. 2, when sheet stock material is drawn from a stack 22 in a direction parallel to the width dimension W, the sheet stock material is pulled generally parallel to the fold lines 34 and forms a different folding or crumpling pattern than that obtained by drawing the sheet stock material from the stack 22 in the conventional manner. The stock material 22 deforms from its generally planar state, tends to shift and twist the fold lines 34, and crumples as the stock material is pulled in this way from the side of the stack.

FIG. 3 shows the supply 20 in combination with a dunnage conversion machine 32, also referred to as a converter 32, for converting the stock material 22 into a relatively less dense dunnage product 48. The conversion machine 32 includes a conversion assembly 33 that includes a feed mechanism 30 with at least one rotatable member operative to draw the sheet stock material from the folded stack 22. In the illustrated embodiment, the feed mechanism 30 has two rotating members 42 and 44, one of which is driven by a motor 46. Exemplary rotating members include rollers, gears, paddles, embossing elements, etc. to draw the sheet stock material from the stack 22 and further act on the stock material to form the dunnage product 48.

When a desired length of dunnage has been produced, the packer can tear the stock material at a tear line 36 (FIG. 1), or the conversion machine 32 can include a severing mechanism (not shown) to sever the desired length of dunnage from the stock material 22.

The crumpling of the sheet stock material as it is pulled from the folded stack 22 reduces or eliminates the need for a forming device, as discussed above. Accordingly, the conversion machine 32 can be much smaller and more compact, providing a dunnage conversion system that takes up less space and has a smaller footprint, particularly a smaller width.

The sheet stock material can be drawn from the stack 22 using a feed mechanism 30 of a dunnage conversion machine 32, as shown in FIG. 3. Since no forming device is needed, the dunnage conversion machine 32 can be reduced to a width a little wider than the depth dimension D of the stack 22. The feed mechanism 30 acts on the stock material 22, such as by compressing the stock material to crease the folds, and by embossing, piercing, or otherwise acting on the stock material to help the resulting dunnage product 48 retain its shape, an example of which is illustrated in the cross-section shown in FIG. 4.

Figure 12:
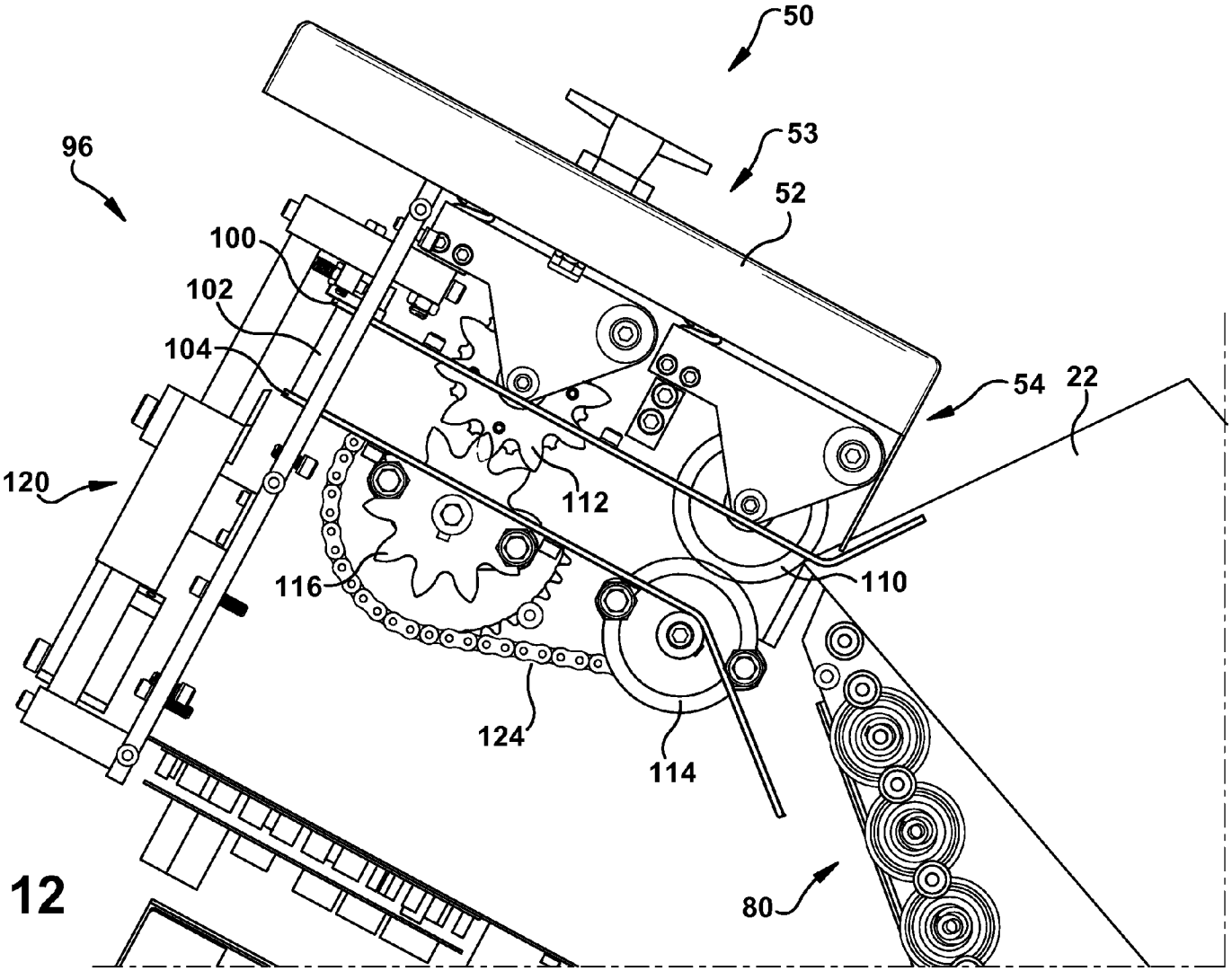
FIG. 12 is an enlarged view of a side of the conversion machine shown in FIG. 11 with additional side panels removed to further illustrate the internal workings of the conversion machine.

Referring now to FIGS. 5-9, we will describe an exemplary embodiment of a dunnage conversion machine provided by the present invention. The conversion machine or converter 50 includes a housing 52 that encloses a conversion assembly 53 (FIG. 12) having a feed mechanism 54 (FIG. 12). The housing 52 is mounted to a stand 56 having multiple wheels 60 for transporting the conversion machine 50 to a desired location. The stand 56 includes a telescopically adjustable upright member 62 to which the housing 52 is mounted for angular adjustment about a horizontal axis. Consequently, this stand 56 allows the dunnage conversion machine 50 to be moved to where it is needed and then adjusted to dispense a dunnage product from a desired height and in a desired direction.

Figure 1:
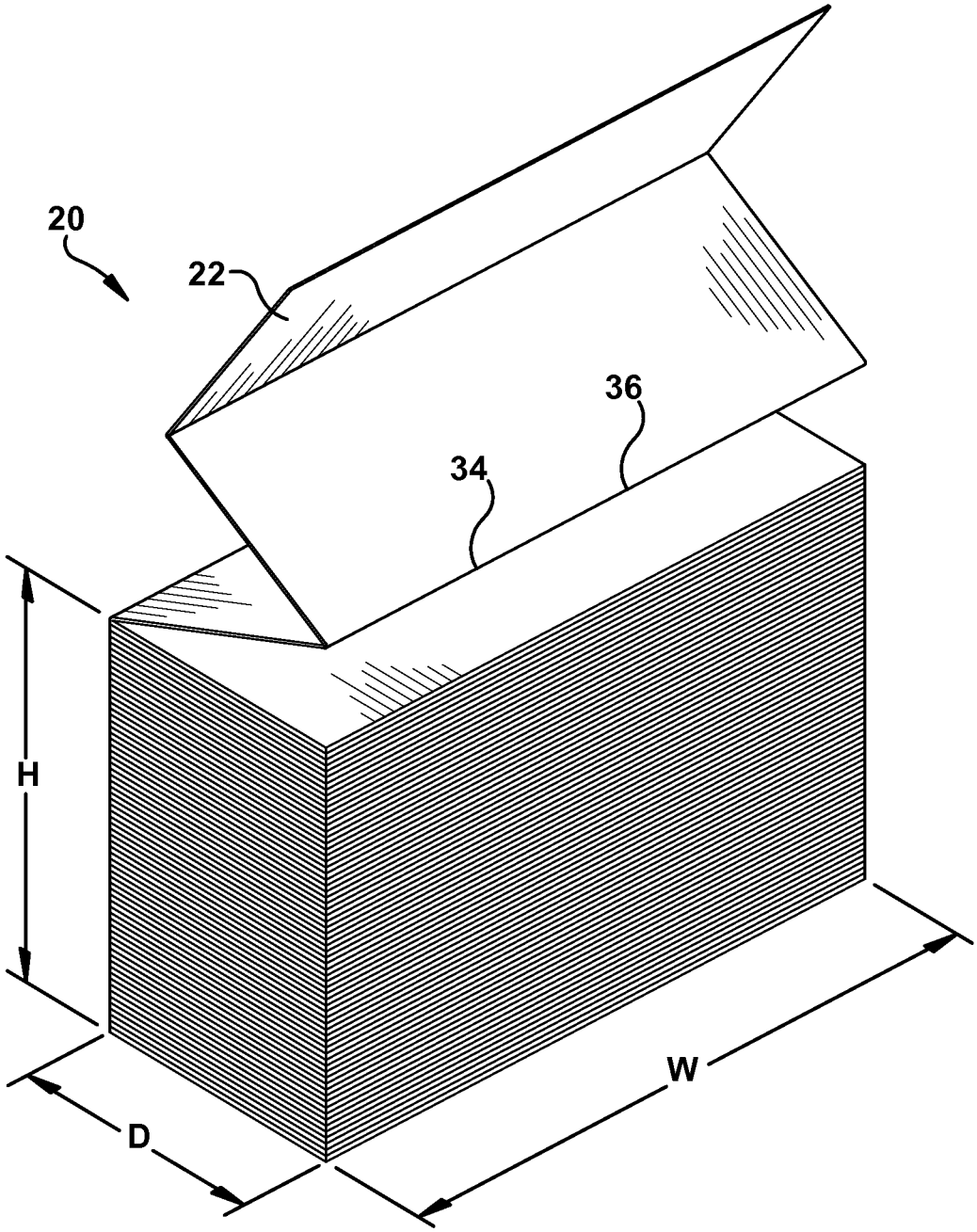
FIG. 1 is a perspective view of a stack of single-ply, fan-folded sheet stock material suitable for conversion into a dunnage product.

A supply 64 of fan-folded sheet stock material, as described above, is supported in a stock supply chamber 70 at a rear or upstream end of the dunnage conversion machine 50. The stock supply chamber 70 is generally rectangular and has a length dimension L and a width dimension W that generally corresponds to the width and depth dimension of the stack 22 of fan-folded sheet stock material (FIG. 1). The stock supply chamber 70 includes upright side walls 72 and rear walls 74 extending inwardly from the side walls 72 for supporting the sides of a stack 22 of fan-folded sheet stock material. The chamber 70 is inclined so that the bottom of the chamber 70 lies at an angle relative to a horizontal plane. A pair of laterally-spaced L-shape or right-angle supports 76 extend the length of the chamber 70 to support lateral edges of the stack 22.

Unlike in the schematic embodiment described above, in this embodiment the sheet stock material is drawn from a bottom side of the stack 22 into the feed mechanism 54 (FIG. 12) in the dunnage conversion machine 50. A sensor can be provided as part of a system with an alarm to alert an operator to the need to replenish the supply before the previous stack is depleted.

When the supply of sheet stock material is nearly spent, a succeeding supply of sheet stock material may be spliced to the nearly spent supply of sheet stock material. To this end, the bottom page of a succeeding supply of sheet stock material may be spliced to the top page of the nearly spent supply of sheet stock material. The succeeding and almost spent supplies of sheet stock material may be spliced together by any suitable means, for example, by taping, gluing, or other attaching means. In an exemplary splicing technique the leading end of the top page of the almost spent supply of sheet stock material is provided with a pressure sensitive adhesive layer and a release liner, with the release liner covering the pressure sensitive adhesive layer. An exemplary adhesive layer and release liner can take the form of an adhesive transfer tape having an acrylic adhesive and a paper strip release liner. By releasing the liner, such as by manually peeling the liner from the pressure sensitive adhesive layer, the end of the top page of the almost spent supply of sheet stock material may be spliced to, or more particularly adhered to, the end of a bottom page of a succeeding supply of sheet stock material.

As will be appreciated, the conversion process can continue uninterrupted while this splicing operation takes place. For example, as the conversion process is taking place, a release liner can be removed from a top sheet to the nearly spent supply of sheet stock material and a succeeding supply of sheet stock material can be placed on top of the nearly spent supply, splicing the top sheet of the nearly spent supply to the bottom sheet of the succeeding supply of sheet stock material to create a combined stack.

Unlike most conversion machines that draw sheet stock material from a roll or the top of a stack, the conversion machine 50 provided by the invention continues to operate throughout the reloading operation, pulling sheets from the bottom of the combined stack 22. To facilitate drawing the bottom sheet off of the stack 22, the bottom sheet is supported on a series of rollers 80 that make it easier to draw the sheet stock material therefrom.

This series or a plurality of rollers 80 support a central portion of the bottom of the stack 22 of fan-folded sheet stock material. The rollers 80 extend above the plane at which the lateral portions of the stack 22 are supported by the L-shape supports 76. And the rollers 80 closer to the conversion machine 50, at the downstream end of the supply chamber 70, extend progressively further above that support plane. This causes the bottom sheet in the stack 22 to bow in a direction perpendicular to the depth of the stack, and creates space on either side of the central rollers 80 for the stock material to draw inwardly and crumple as it is pulled from the bottom of the stack.

The stock supply chamber 70 is mounted on one or more drawer slides 82 to allow the chamber 70 to be pulled away from the housing 52 to facilitate loading a fresh stack 22 of stock material. The illustrated embodiment employs a pair of drawer slides 82 mounted to an outside surface on each side of the chamber 70. A single slide under the chamber 70 may be sufficient if it is strong enough to support a loaded chamber. Additionally, the chamber 70 can be mounted below the housing 52 to facilitate loading stock material from the front or output side of the converter 50. In such an arrangement the sheet stock material is preferably continuously positively engaged and supported as it is pulled into the converter.

Figure 10:
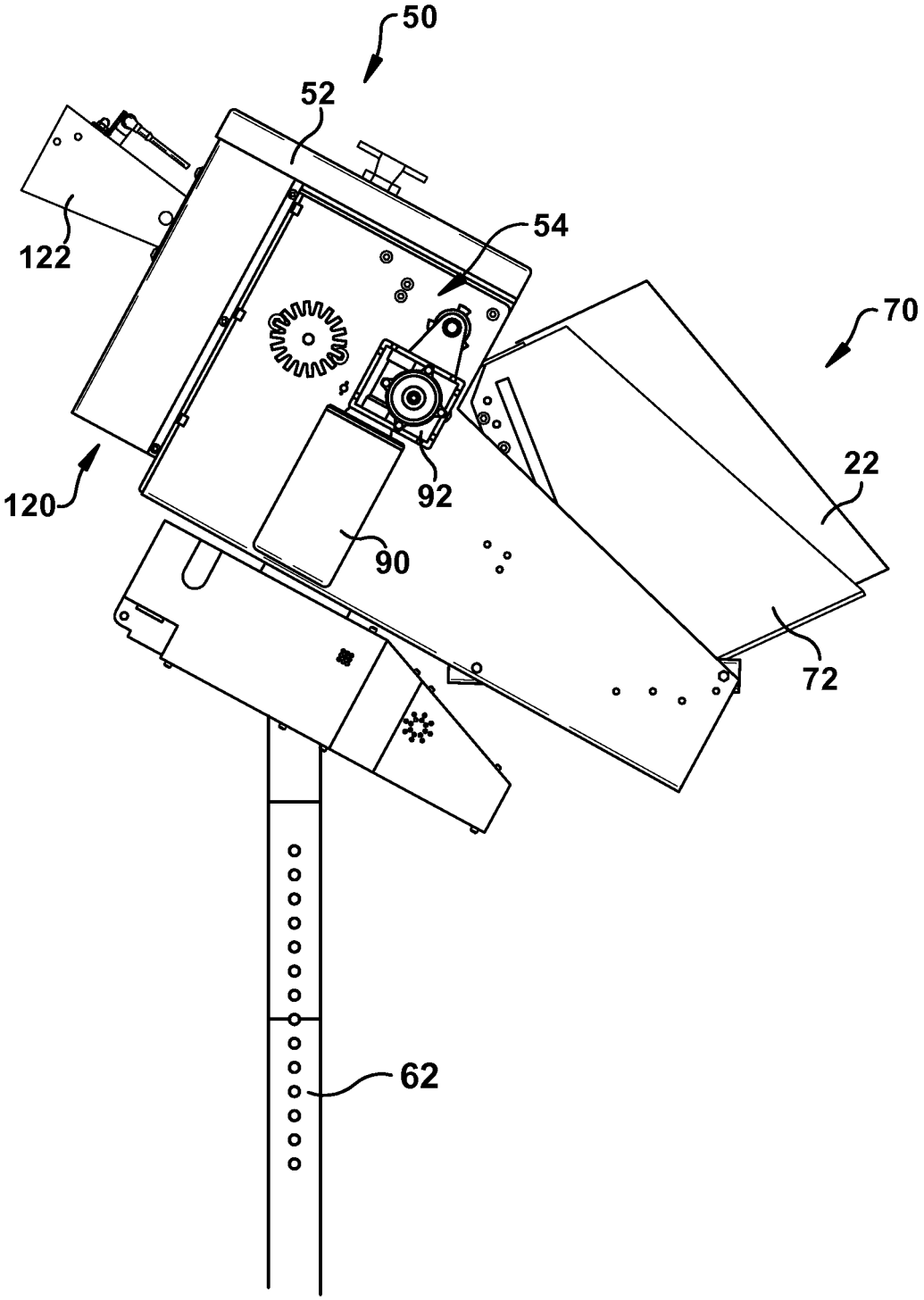
FIG. 10 is a side view of the dunnage conversion machine of FIG. 6 with a side panel removed.
Figure 11:
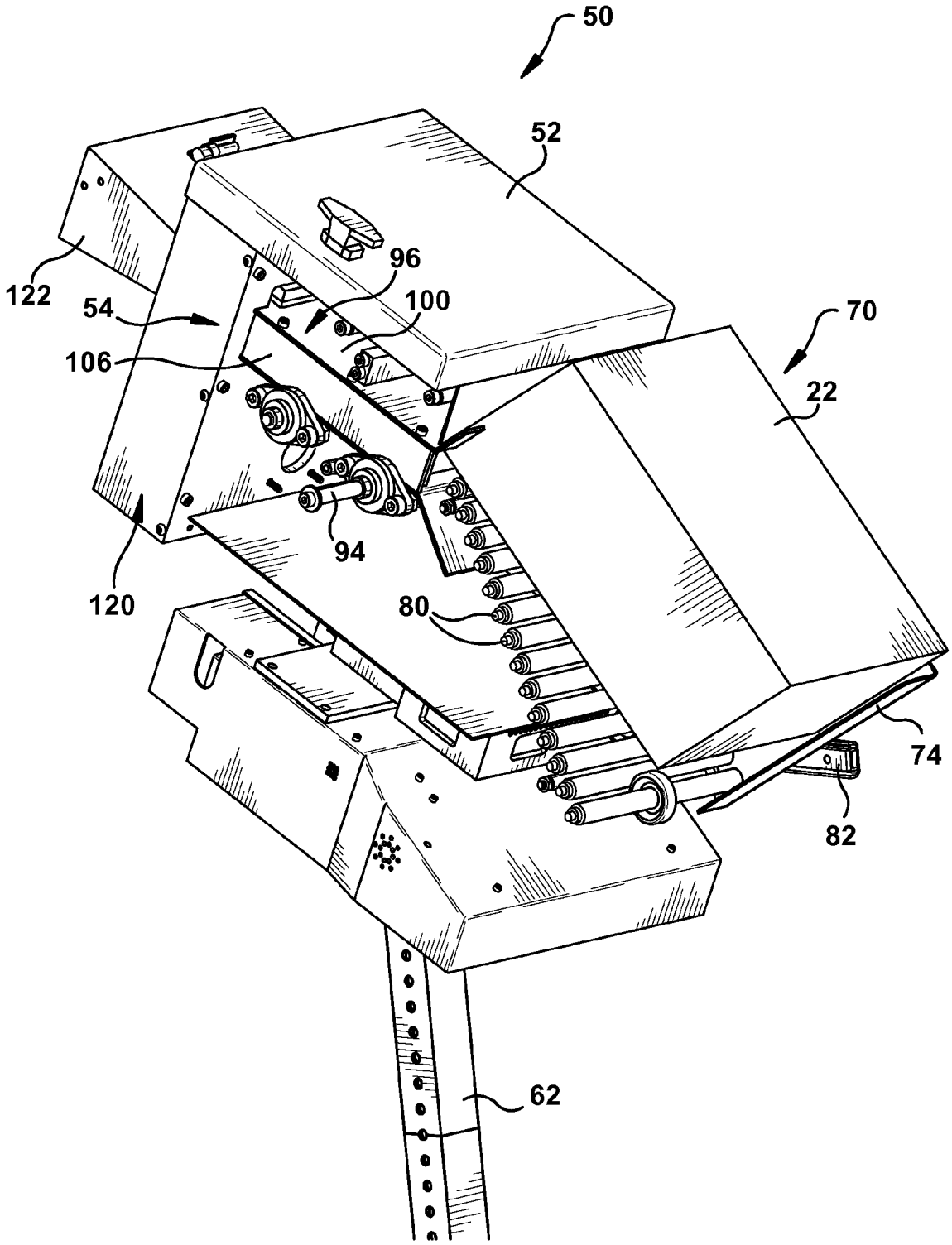
FIG. 11 is a perspective view with additional side panels removed to show internal features of the conversion machine.

The feed mechanism 54 and related components will be described with reference to FIGS. 10-12. As shown in FIG. 10, the feed mechanism 54 includes a feed motor 90 mounted to one side of the housing 52 to provide power via a gearbox 92. The drive shaft 94 for the motor 90 and the gearbox 92 is shown in FIG. 11, in which additional side panels have been removed from the housing 52 to show further details of internal components of the conversion machine 50. With one side panel removed from the stock supply chamber 70, FIG. 11 shows the rollers 80 that define the bottom side of the stock supply chamber 70 and a stack 22 of fan-folded sheet stock material thereon. Stock material pulled from the chamber 70 and fed into the feed mechanism 54 enters a generally rectangular tunnel defined by upper, lower, and lateral sides walls 100, 102, 104, 106 that peripherally bound the path of the stock material to guide the stock material as it travels through the feed mechanism 54.

As shown in FIG. 12, the feed mechanism 54 includes pairs of upstream and downstream rotating members that draw the sheet stock material from the supply 64, crumple the stock material within the guide chute tunnel 96, and then connect overlapping layers of the stock material so that the resulting dunnage product retains a crumpled shape.

Turning to further details of the feed mechanism 54, the upper rotating members 110 and 112 are resiliently biased toward the lower rotating members 114 and 116, which extend through a bottom wall of the guide tunnel 96. The upper rotating members 110 and 112 extend through openings in an upper wall 100 of the guide tunnel 96 and are biased toward a corresponding lower feed member 114 and 116. The upstream pair of rotating members 110 and 114 are formed of resilient wheels which grip and feed the sheet stock material from the stack 22 into the feed mechanism 54. As previously noted, the downstream rotating members 112 and 116 pass sheet stock material therebetween at a slower rate than the upstream feed members 110 and 114, thereby causing the sheet stock material to crumple in the confined space between the upstream and downstream rotating members. The downstream rotating members 112 and 116 also perform a connecting function, perforating and connecting multiple layers of sheet stock material as it passes between the rotating connecting members 112 and 116 to form a complete strip of dunnage.

The dunnage strip continues to a severing mechanism 120 downstream of the feed mechanism 54, which separates a discrete length of dunnage product from the strip of dunnage. The severed segments of dunnage product are dispensed through an output chute 122 for retrieval by a packer.

The motor 90 of FIG. 10 drives the upstream feed members 110 and 114 directly via the gear box 92, and a chain drive 124 couples the upstream feed members 110 and 114 to the downstream feed members 112 and 116. The upper rotating members 110 and 112 are idlers and are not positively driven except to the extent that they rotate due to friction or engagement with the lower rotating members 114 and 116 or the strip of dunnage passing therebetween. The size of the gear wheels used with the chain drive can be varied to vary the speed ratio between the upstream feed members 110 and 114 and the downstream feed members 112 and 116.

Figure 13:
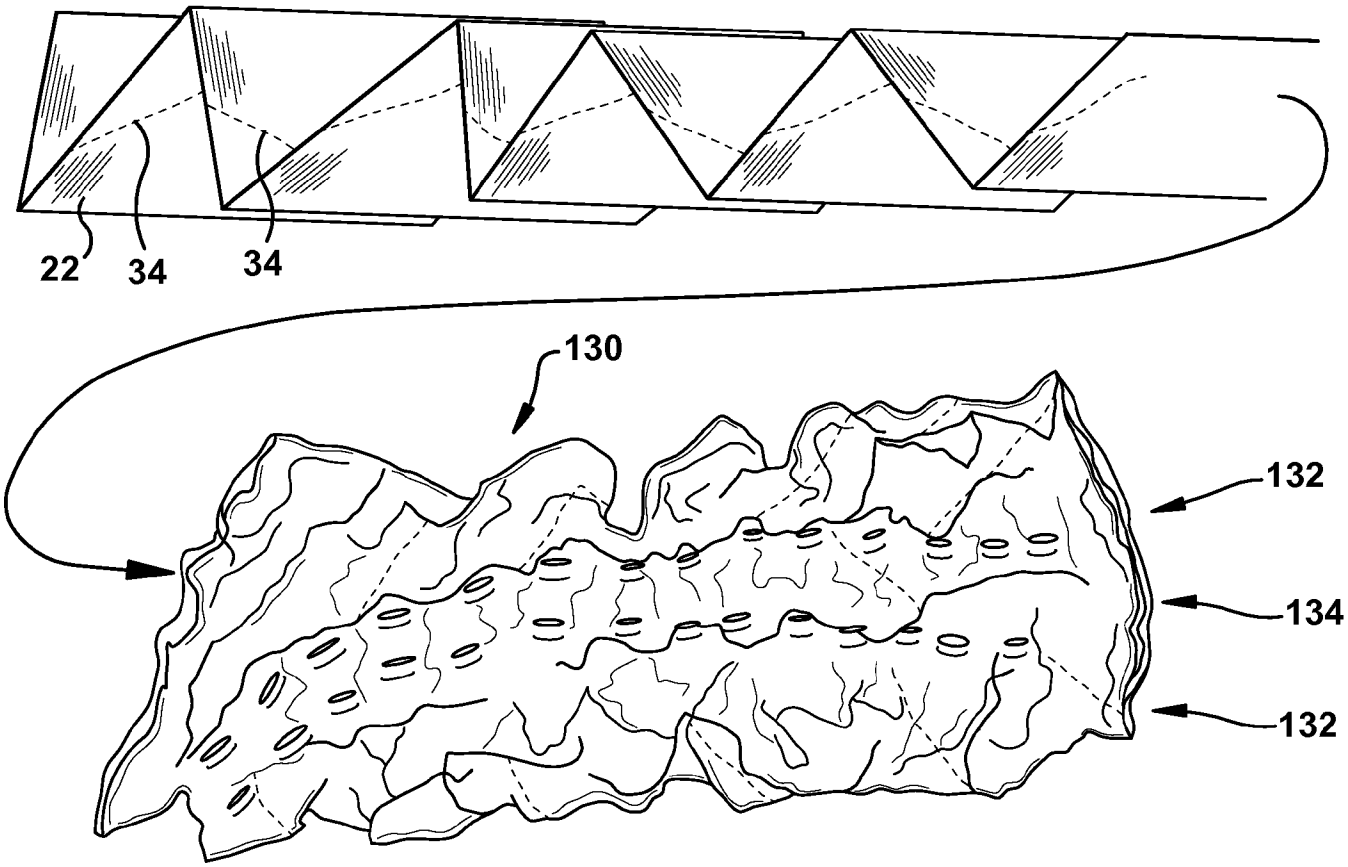
FIG. 13 is a schematic perspective view of an exemplary dunnage product provided in accordance with the invention.
Figure 14:
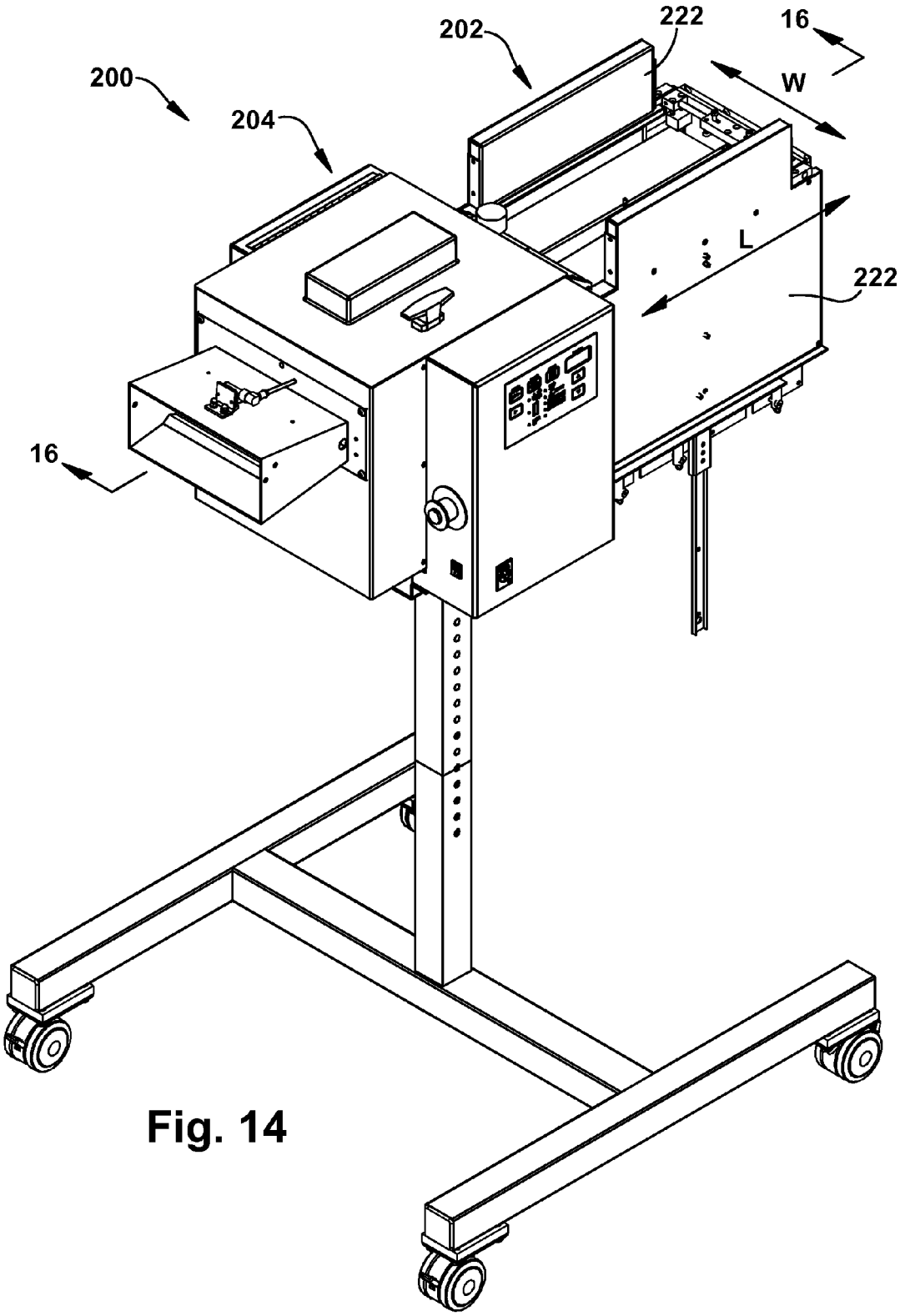
FIG. 14 is a perspective view of another exemplary dunnage conversion machine provided in accordance with the present invention as seen from a downstream end.
Figure 15:
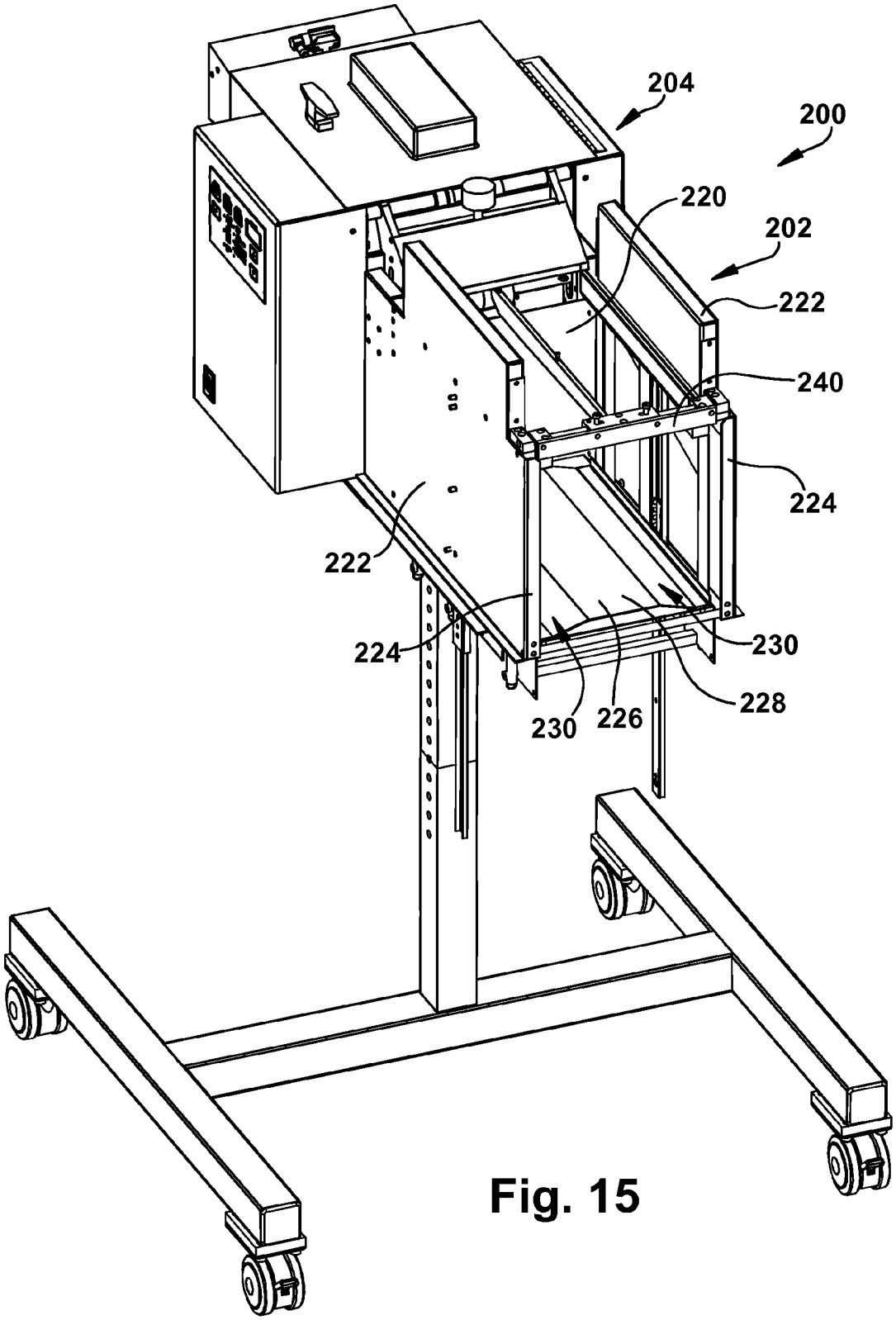
FIG. 15 is a perspective view of the dunnage conversion machine of FIG. 14 as seen from an upstream end.

FIG. 13 shows the shingling of the fan-folded sheet material 22 as it is pulled from the stack with angled fold lines 34, and the resulting dunnage product 130. This dunnage product 130 is unlike any other known dunnage product and is very flexible if bent about a vertical or horizontal axis, and provides a significant amount of cushioning. The dunnage 130 has laterally-spaced cushioning portions 132 with a narrow central band 134 that is more compressed where the downstream feed members 112 and 116 (FIG. 10) connected the layers of stock material together with two rows of tabs. The result is not unlike a series of cushioning vertebrae connected together along a central spine, with some flexibility for wrapping around objects or bending to fill unusual voids in a packing container.

Another exemplary embodiment of a dunnage conversion machine 200 provided by the invention is shown in FIGS. 14-24. As in the previous embodiment, the converter 200 is designed to draw stock material from a fan-folded stack 201 in a lengthwise direction parallel to the fold lines. The converter 200 has a stock supply chamber 202 at an upstream end of the converter 200 for supporting a supply of sheet stock material in the form of a fan-folded stack 201, and a conversion assembly 204 for drawing sheet stock material from the stock supply chamber 202 and converting the stock material into a crumpled dunnage product. Unlike the previous embodiment, however, the conversion assembly 204 in this converter 200 draws sheet stock material from a top of the stack 201 supported in the supply chamber 202.

Figure 16:
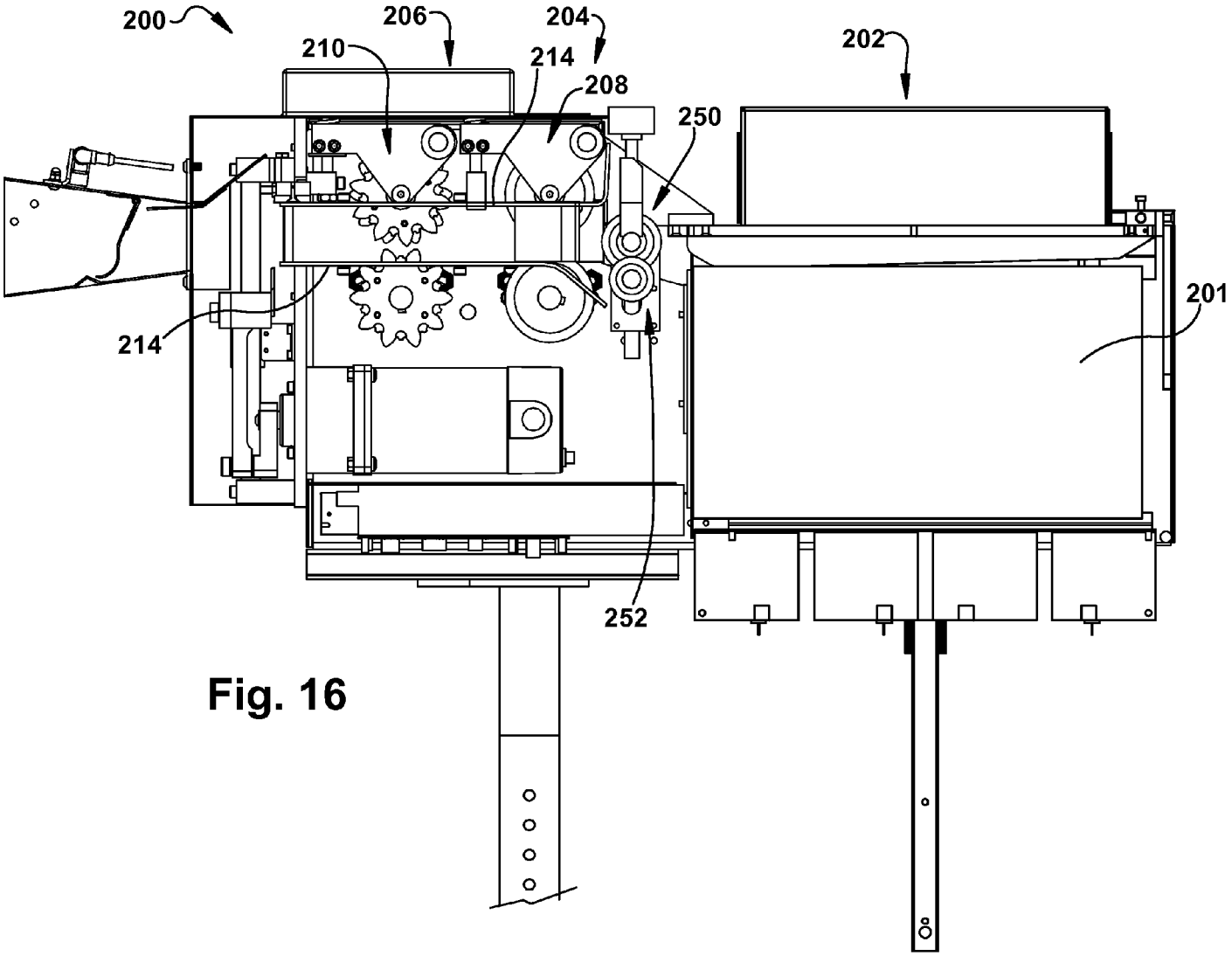
FIG. 16 is a cross-sectional view of the dunnage conversion machine of FIG. 14, as seen along lines 16-16 in FIG. 14.
Figure 17:
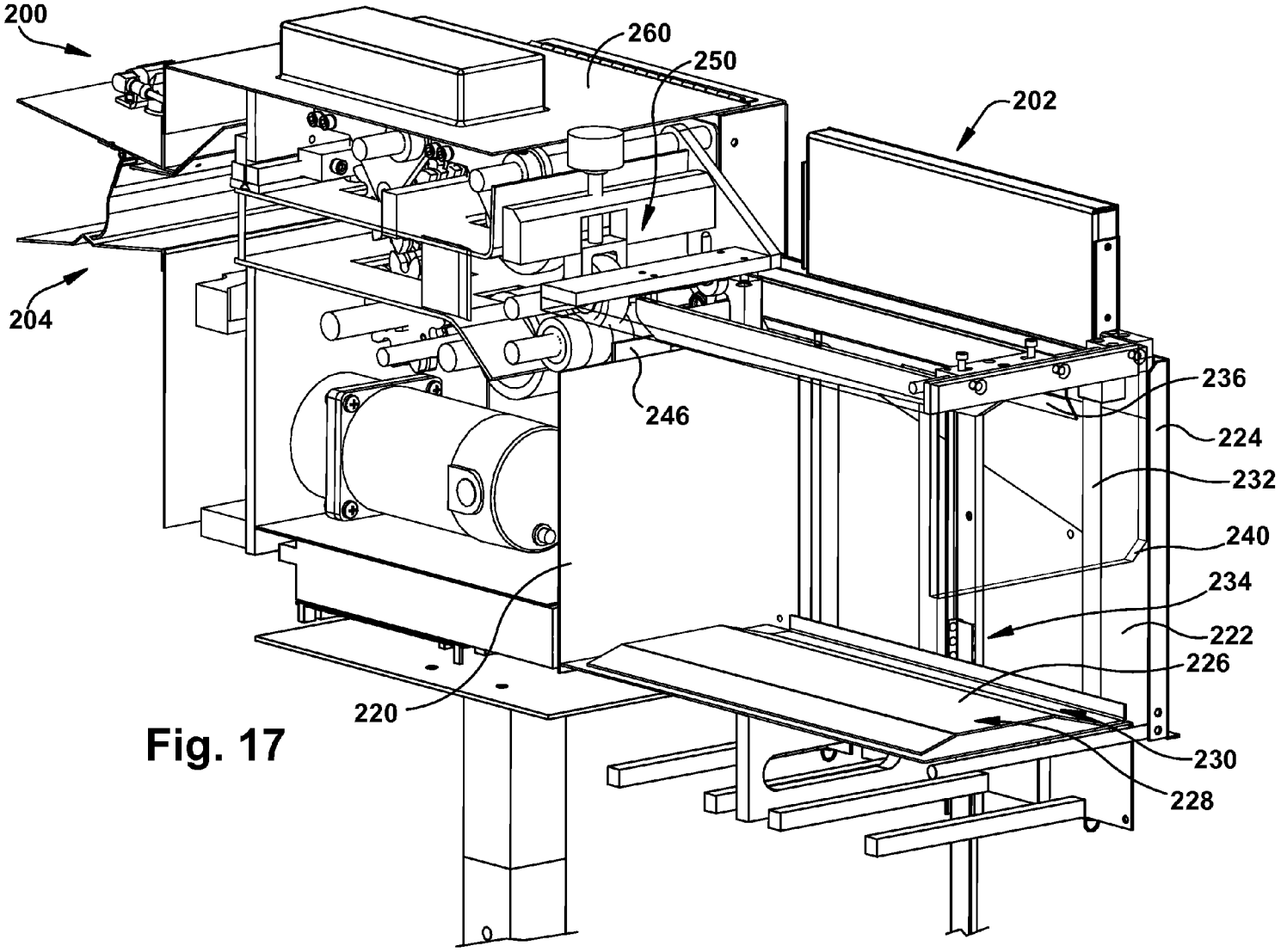
FIG. 17 is a perspective view of the conversion machine shown in FIG. 16 as seen from an upstream end with a stack of sheet stack material removed to more clearly see the stock supply.
Figure 18:
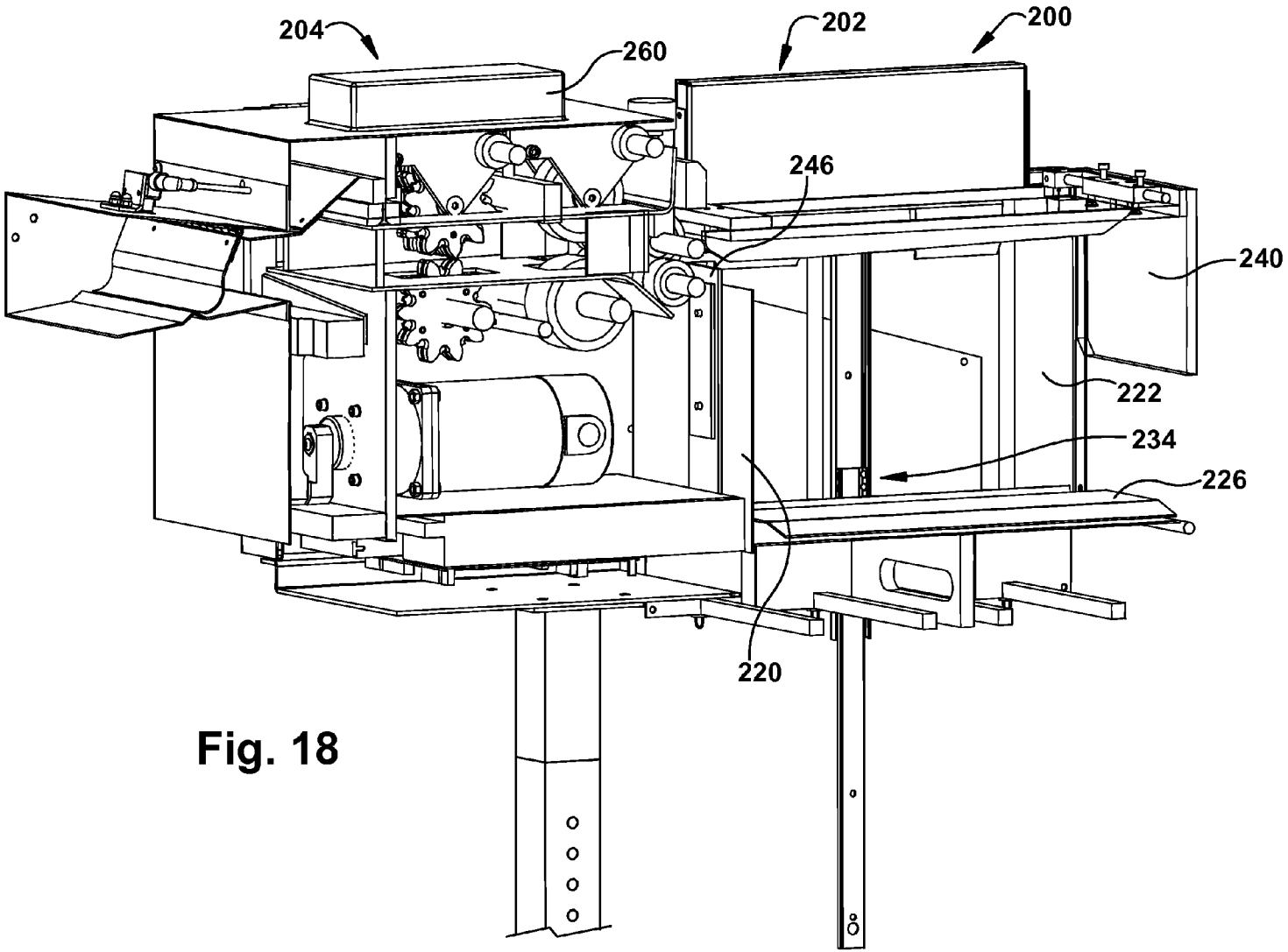
FIG. 18 is a perspective view of the conversion machine shown in FIG. 17 as seen from a downstream end.

As shown in FIG. 16, the conversion assembly 204 is similar to the conversion assembly 53 shown in FIG. 12, with the following differences. Like the conversion assembly 53, the conversion assembly of 204 has a feed mechanism 206 that includes upstream and downstream sets of rotating members 208 and 210, respectively, to draw the stock material from the supply chamber 202, crumple the stock material within a guide chute tunnel 214 and connect overlapping layers to retain the dunnage product in a crumpled state, much the same way that the conversion assembly 53 operates, as described above.

The stock supply chamber 202 is generally rectangular and has a length dimension L and a width dimension W that generally corresponds to the width and depth of the stack of fan folded sheet stock material. The stock supply chamber 202 has a downstream or front wall 220 mounted adjacent the conversion assembly 204, a pair of parallel upright side walls 222 extending from laterally-spaced sides of the front wall 220, and one or more rear walls 224 opposite the front wall 220 that extend inwardly from the side walls 222, to support the sides of the stack 201. The opening between the rear walls 224 in the illustrated embodiment facilitates loading a new stack 201, and observing how much stock material remains in the chamber 202.

In place of the rollers 80 (FIG. 12) of the previous embodiment, the stock supply chamber 202 has a bottom surface 226 with an elevated center region 228 in a center portion extending along the length dimension L between recessed lateral side regions 230 adjacent the lengthwise-extending side walls 222. Thus the bottom surface 226 provides a convex support surface 226 for the stack 201 of fan-folded sheet stock material. The stack 201 generally is thicker at the lengthwise-extending folded edges, and the convex shape of the bottom support surface 226 provides an approximately level upper surface of the stack 201 in the stock supply chamber 202. This is believed to facilitate producing a better dunnage product with a more consistent shape.

The bottom support surface 226 in this embodiment is movable, and preferably is supported by means for raising the height of the stack 201 as sheet stock material is drawn therefrom, to maintain a substantially constant elevation of the top surface of the stack 201. Consequently, the raising means and support surface 226 form an elevator. In the illustrated embodiment, the support surface 226 is upwardly biased by springs 232, and guided in its movement by telescoping slide guides 234, one portion of which is connected to the support surface 226 and another portion is connected to one of the side walls 222 of the stock supply chamber 202. Stops 236 on the side walls 222 of the stock supply chamber 202 limit the upper extent of the movement of the support surface 226.

The stock supply chamber 202 also includes a cover 240 that extends over a top side of the stock supply chamber 202. The illustrated cover 240 further extends over a portion of the rear walls 224. The cover 240 extends from the housing for the conversion assembly 204, and thus also can decrease noise from the conversion assembly 204.

The stock supply chamber 202 that supports the supply of sheet stock material further includes fold-forming control features integrated therein that control movement in the sheet stock material as it is drawn from the stock supply chamber. In the illustrated embodiment, these features are primarily incorporated into or coupled to the cover 240. In particular, the cover 240 has a longitudinally-extending protrusion or spine 242 that extends into the stock supply chamber 202. The spine 242 has a sloped bottom surface facing into the stock supply chamber 202. The bottom surface of the spine 242 slopes downward toward the downstream end of the chamber 202 and engages an upper surface of the stack 201 of fan-folded sheet stock material at a downstream end of the stock supply chamber 202, adjacent the conversion assembly 204. This spine 242 helps to maintain tension in a center of the sheet stock material and facilitates folding and crimping in the stock material as it is drawn from the stack 201.

As the stock material is drawn from the stack 201, folded portions of the upper sheet or sheets puff upward on alternating sides of the stack, depending on which side of the sheet at the top of the fan-folded stack 201 is connected to a next sheet at a fold line. The centrally-positioned spine 242 inhibits these puffed portions from moving laterally across the top of the stack 201, and helps to ensure consistent tracking of the stock material in a downstream direction to the conversion assembly 204. As the top sheet is displaced from the stack 201 and moves downstream and under the spine 242, the spine 242 also may help to crease folds in the stock material before it enters the conversion assembly 204.

The cover 240 also includes a pair of blocks 244 mounted to engage the upstream or rear corners at the top surface of the stack 201 of sheet stock material. As the top sheet is displaced from the stack 201, the upstream corners of the sheet tend to move upwardly and laterally. These corner blocks 244 keep the corners of the stock material from moving upward until the corners of the sheet move from under the blocks 244, by which time the sheet is further under the spine 242 and in closer engagement with the sloping bottom surface of the spine 242. The top sheet can only move laterally, although inhibited in doing so by the central spine 242, or in the downstream direction in which it is drawn. This also helps to ensure that the stock material folds properly as the top sheet is pulled from the stack 201 in the stock supply chamber 202 and into the conversion assembly 204.

Finally, the stock supply chamber 202 includes a vertically-adjustable member 246 between the stock material support (bottom surface 226 of the chamber 202) and the feed mechanism 206. The vertically-adjustable member defines a lower edge of a passage from the stock supply chamber 202 to the feed mechanism 206. The vertically-adjustable member 246 is mounted to the front wall 220 of the chamber 202 for vertical adjustment relative to the front wall 220 to adjust the height of a gap above the top of the front wall 220 that forms the passage from the stock supply chamber 202 to the feed mechanism 206. This vertically-adjustable member 246 is narrower than the front wall 220, however, effectively forming a passage that is taller toward the sides to allow the stock material to expand on the lateral sides as it passes the top of the front wall 220.

The conversion machine 200 further includes a pair of adjustable pinch rollers 250 and 252 between the stock supply chamber 202 and the feed mechanism 206. A lower roller 252 is biased, such as with a spring, toward an upper roller 250. The upper roller 250 is adjustable vertically to move the point of contact between the upper and lower rollers 250 and 252, such as through the threaded screw and hand knob in the illustrated embodiment. The upper roller 250 is mounted to the cover 240 of the stock supply chamber 202 to separate the rollers 250 and 252 when the cover 240 is opened to load a new supply of stock material. In the illustrated embodiment the lower roller 252 is wider than the upper roller 250. As the paper is pulled from the stack, the greater width of the lower roller 252 encourages the stock material to expand and fold on the opposite side adjacent the upper roller 250 and away from the top of the stack. Neither of the pinch rollers 250 and 252 is driven, however, the lower roller 252 is spring-biased toward the upper roller 250 to pinch the stock material therebetween, and the rollers 250 and 252 generally are centrally located to engage a center of the stock material as it is drawn into the feed mechanism 206.

By moving the upper roller 250 up, thereby raising the contact point between the rollers 250 and 252 relative to the upper surface of the stack 201 of sheet stock material, the amount of stock material released from the stack 201 into the feed mechanism 206 will decrease. When the upper roller 250 is lowered, lowering the contact point between the rollers 250 and 252 relative to the upper surface of the stack 201, the amount of stock material released from the stack 201 is increased. This also decreases the yield, the amount of dunnage produced relative to the amount of sheet stock material supplied to the feed mechanism 206. The downstream set of rotating members 210 also may need to be adjusted to accommodate the change in the volume of stock material to ensure that the overlapping layers are properly crimped so that they will hold together, and to prevent or minimize tearing in a thinner strip of crumpled stock material. These adjustments also effect the width and thickness of the stock material. When the contact point is lowered and more sheets enter the feed mechanism 206, the resulting dunnage pad becomes wider but thinner, and as the contact point is raised, the resulting pad becomes narrower yet thicker.

Figure 20:
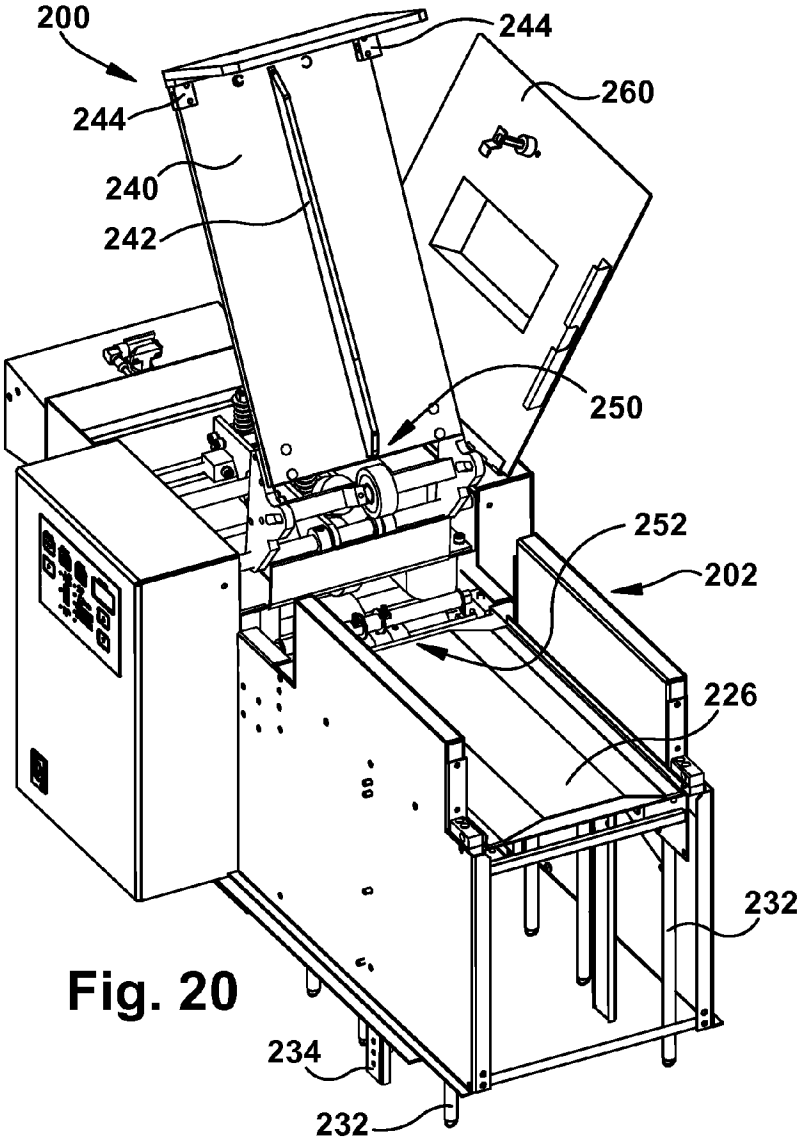
FIGS. 19-25 are sequential perspective views illustrating the process of loading a supply of sheet stock material into the dunnage conversion machine of FIG. 14.
Figure 19:
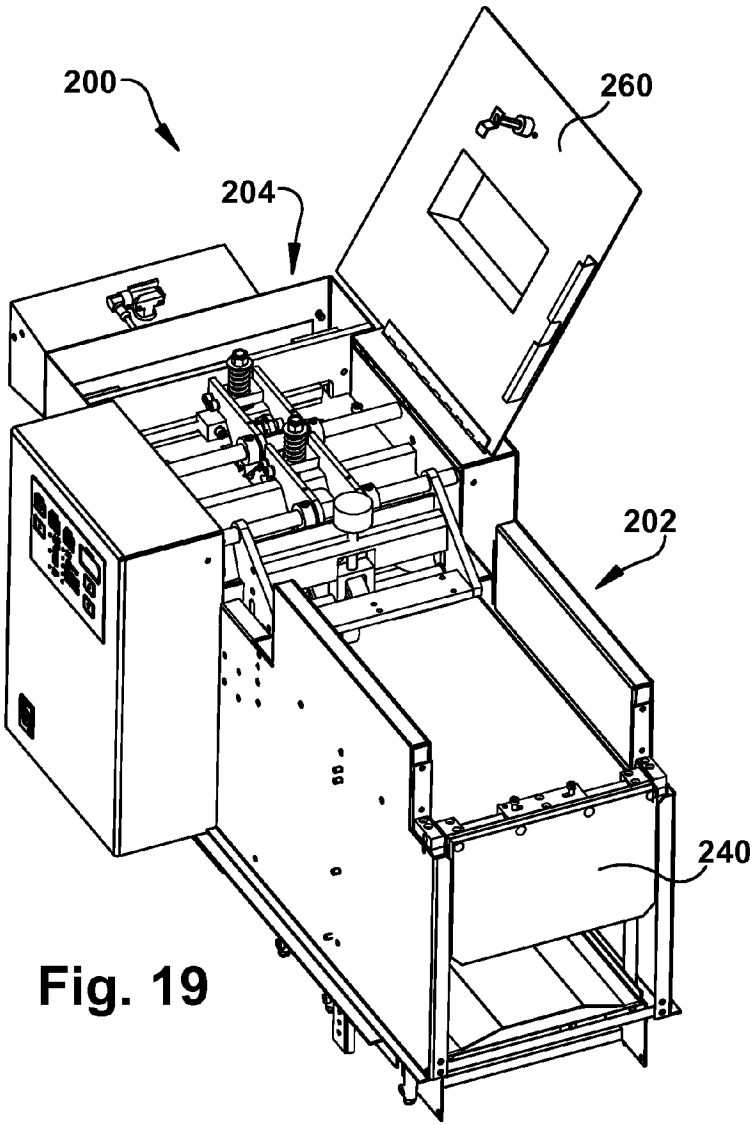
Figure 22:
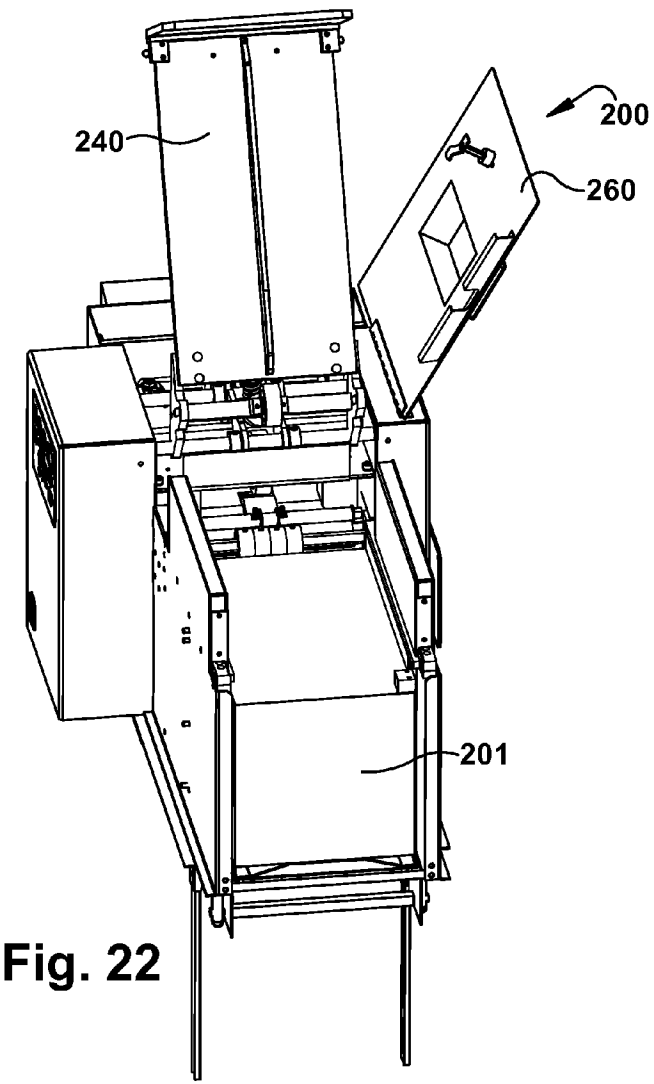

The sequence of loading the conversion machine 200 with a fresh stack 201 of fan-folded sheet stock material will now be described with reference to FIGS. 19-25. A sensor can be used to indicate to the operator that the supply of stock material is nearly depleted, or to stop the conversion assembly 204 automatically. To begin, the operator unlatches a door 260 in the housing over the feed mechanism 206 (FIG. 19), and then raises the cover 240 from the stock supply chamber 202, separating the upper pinch roller 250 from the lower pinch roller, as shown in FIG. 20.

Figure 21:
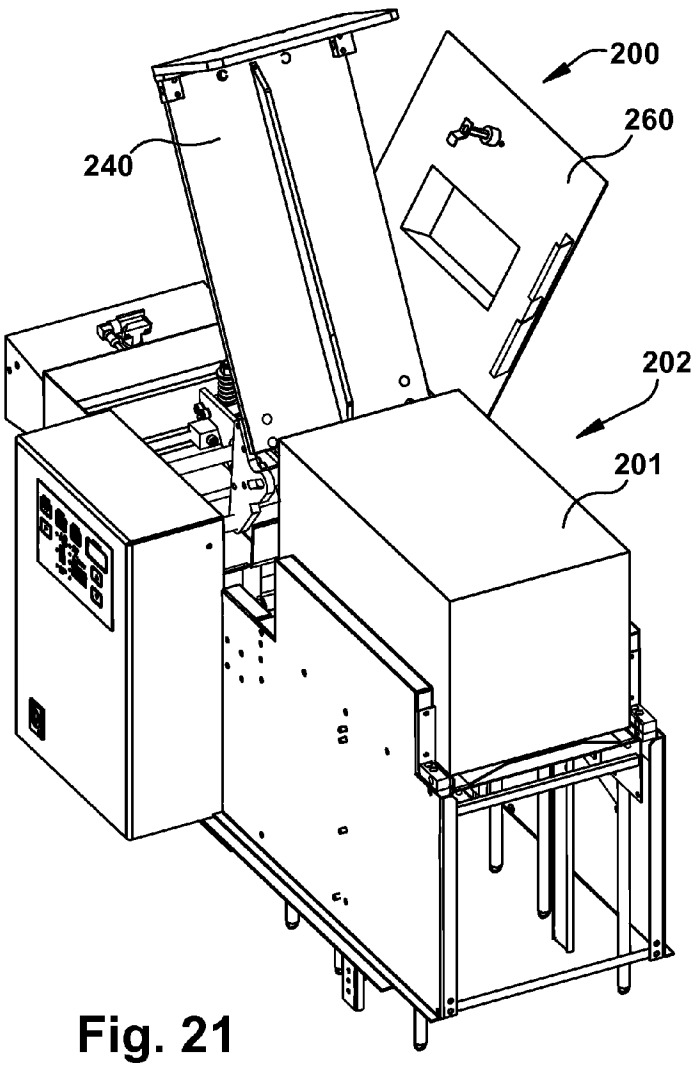

A bundle of fan-folded sheet stock material is placed on the bottom surface 226 of the stock supply chamber 202 (FIG. 21). Any strapping or support structure is removed from the bundled stack, and the operator can push the stack 201 and the support surface 226 downward into the stock supply chamber 202. If stock material remains from a previous supply, a bottom sheet of the previous supply can be spliced to the top sheet in the new stack 201, such as with an adhesive pre-applied to one or the other. The pre-applied adhesive and release liner described in connection with the previous embodiment is one effective method.

Figure 24:
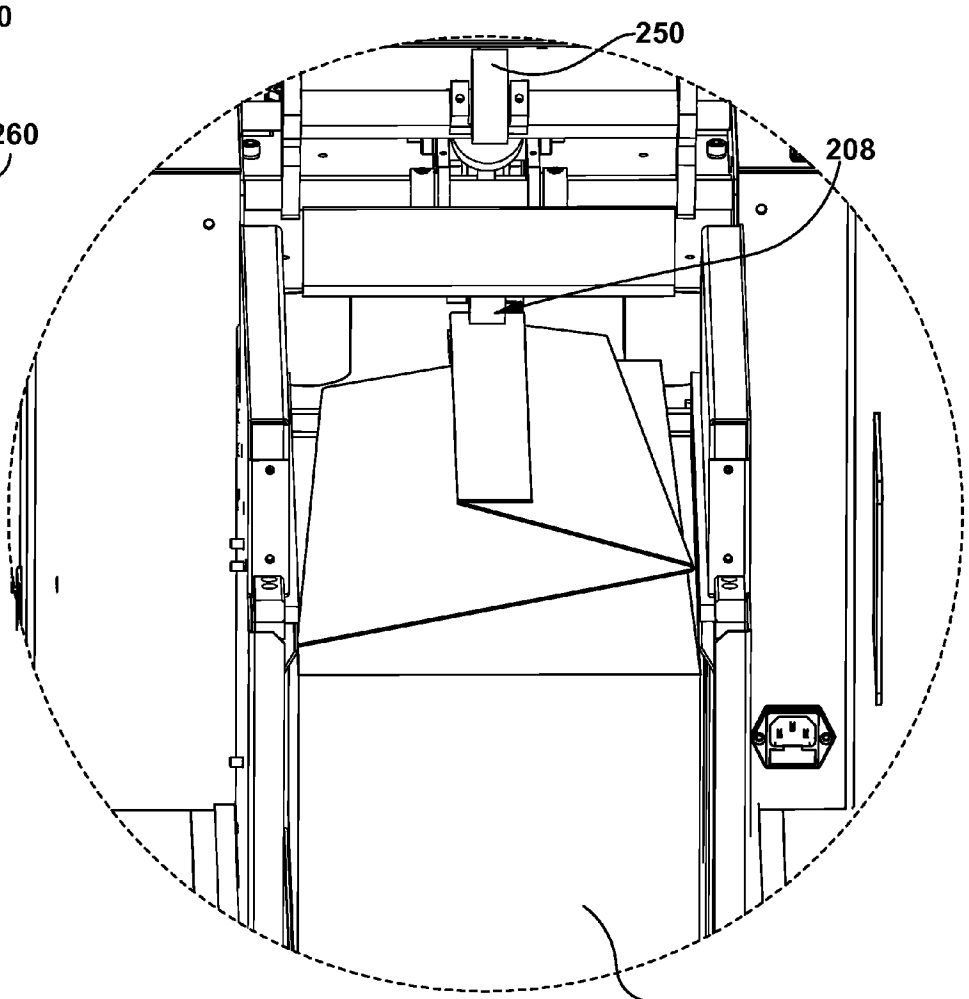
Figure 23:
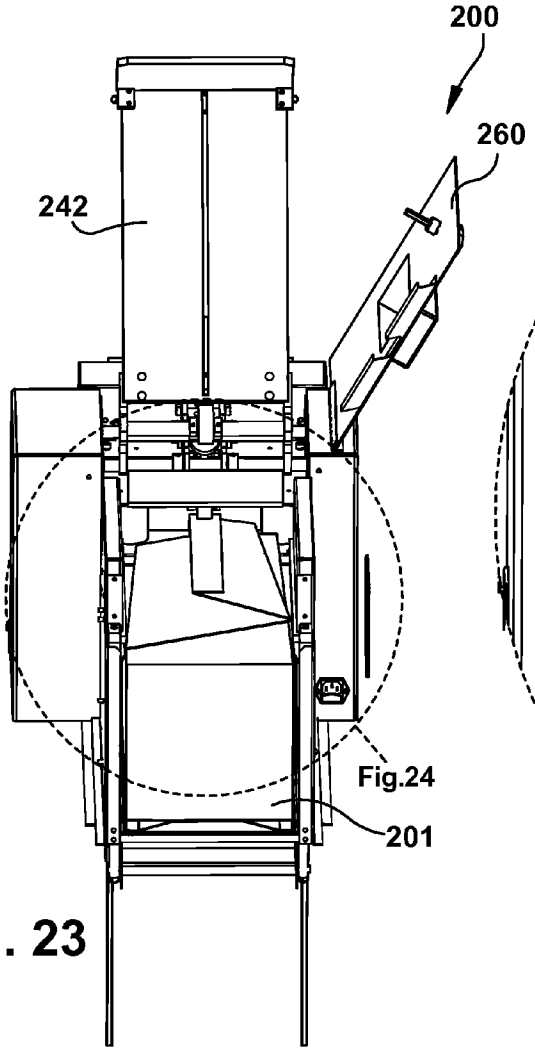
Figure 25:
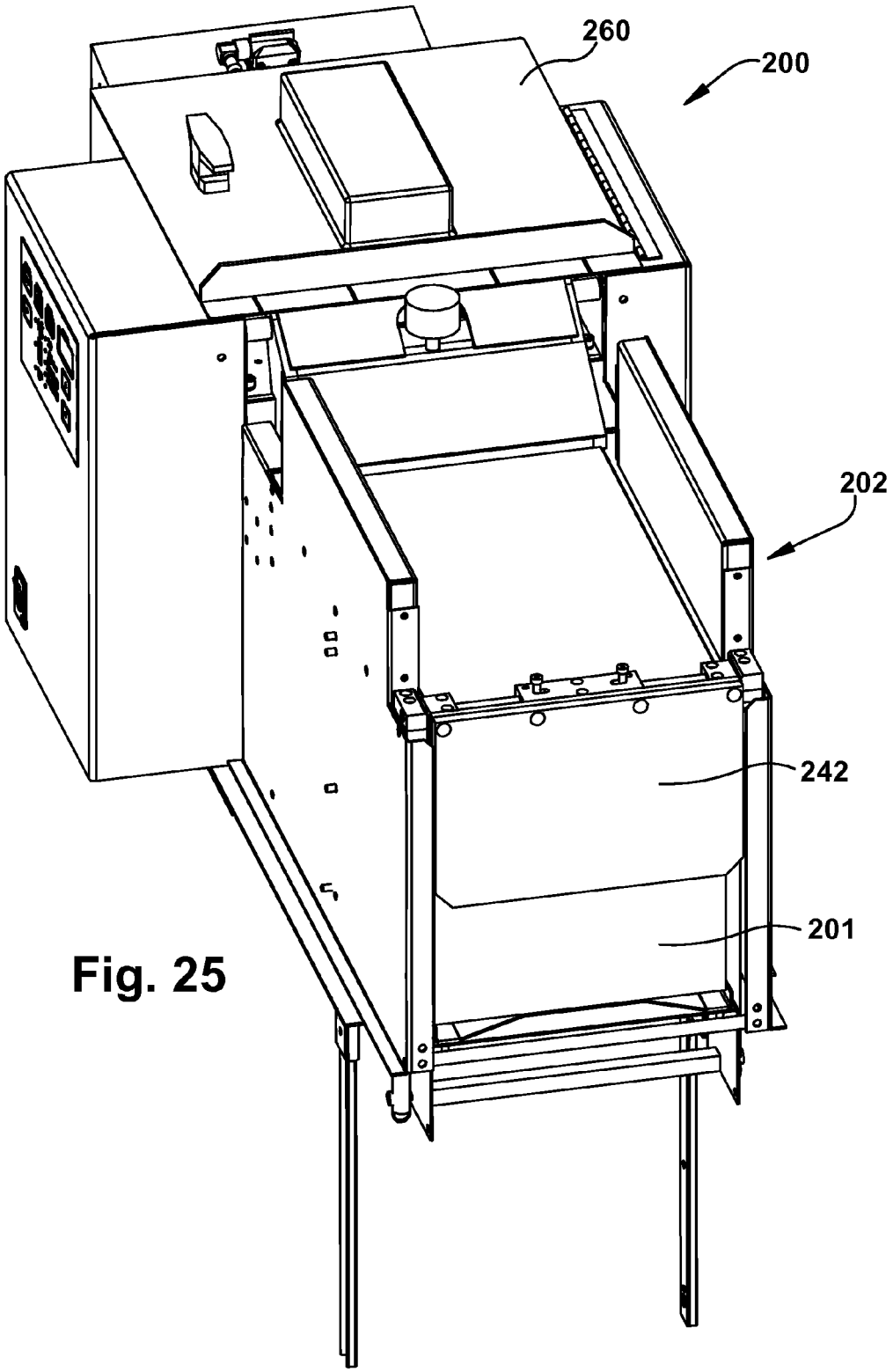

One or more of the top sheets of stock material are then pulled from the stack 201 and placed in the nip of the upstream rotating members 208 in the feed mechanism 206 (FIGS. 23 and 24). The rear cover 240 is then replaced over the stock supply chamber 202, capturing the stock material between the pinch rollers 250 and 252 (FIG. 16), and the door 260 is closed over the conversion assembly 204 and relatched (FIG. 25). The conversion machine 200 is now ready to convert the stock material into a dunnage product.

Accordingly, these conversion machines enable the use of a relatively wide stock material to produce dunnage products having advantages in relatively high density and volume that would otherwise generally would not be possible from a narrower stock material. Drawing sheet stock material sideways from the stack also reduces or eliminates the need to form the stock material as it is pulled through a dunnage conversion machine, thereby reducing the size of the machine.

The present invention also provides a supply of sheet stock material for conversion into a relatively less-dense dunnage product. The supply includes a stack of fan-folded sheet stock material having a width dimension and fold lines generally parallel to the width dimension. The supply provides a relatively wide sheet stock material within a narrower footprint, reducing or eliminating the need to form the sheet material before it is pulled into a feed mechanism in a dunnage conversion machine.

In summary, the present invention provides a method of converting a supply of sheet stock into a relatively less dense dunnage product, including the following steps of (i) providing a stack of fan-folded sheet material having fold lines parallel to a width dimension; and (ii) drawing sheet stock material from the stack in a direction parallel to the width dimension.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

We claim:

1. An apparatus for converting a supply of sheet stock material into a relatively less dense dunnage product, the supply including a stack of fan-folded sheet stock material having a width dimension, and the sheet stock material having fold lines arranged parallel to the width dimension; the apparatus comprising:

a housing enclosing a feed mechanism configured to draw fan-folded sheet stock material in a downstream direction parallel to the width dimension, and a support located upstream of the housing, the support having a first side and a second side extending upright from a bottom surface of the support, and a third side perpendicular to the bottom surface, wherein the first, second, and third sides define a rectangular prism volume sized and configured to receive and support the stack with the width dimension aligned parallel with the downstream direction;

wherein the bottom surface of the support includes three adjacent portions extending in the downstream direction, the three adjacent portions including laterally-spaced portions configured to support lateral edges of the stack, and an elevated center portion between the laterally-spaced portions, the elevated center portion being configured to support a central portion of the stack at an elevation above the laterally-spaced portions.

2. An apparatus as set forth in claim 1, where the feed mechanism includes a pair of rotating members to draw sheet stock material from the support and advance the sheet stock material in the downstream direction.

3. An apparatus as set forth in claim 1, where the feed mechanism includes an upstream pair of rotating members to draw sheet stock material from the support and advance the sheet stock material in a downstream direction to a downstream pair of rotating members that interlock overlapping layers of sheet stock material as the sheet stock material passes between the downstream rotating members.

4. An apparatus as set forth in claim 3, where the upstream rotating members feed sheet material at a faster rate than the downstream rotating members feed sheet stock material to cause sheet stock material to crumple between the upstream and downstream rotating members.

5. An apparatus as set forth in claim 1, where the feed mechanism includes a tunnel that defines a path for the sheet stock material through the housing, the tunnel bounding at least two sides of the path.

6. An apparatus as set forth in claim 5, where the tunnel has a rectangular cross-section.

7. An apparatus as set forth in claim 1, where the elevated center portion is formed by a plurality of rollers whose upper extents extend progressively further above a plane including the laterally-spaced portions the nearer the roller is to a downstream end of the support.

8. An apparatus as set forth in claim 1, where the bottom surface of the support is inclined at an angle relative to a horizontal plane, each laterally-spaced portion having a downstream end opposite an upstream end, the downstream ends of the laterally-spaced portions and the elevated central portion of the support being higher than the upstream ends of the laterally-spaced portions.

9. An apparatus as set forth in claim 1, where the bottom surface of the support is movable and upwardly biased to maintain an upper surface of the stack at a relatively constant elevation.

10. An apparatus as set forth in claim 1, comprising fold-forming control features integrated into the support, the fold-forming control features controlling movement in the sheet stock material being drawn from the support.

11. An apparatus as set forth in claim 1, comprising a vertically-adjustable member between the support and the feed mechanism that defines an edge of a passage from the support to the feed mechanism.

12. A method of converting a supply of sheet stock into a relatively less dense dunnage product, comprising the following steps:

(i) providing a stack of fan-folded sheet stock material having fold lines parallel to a width dimension; and (ii) drawing sheet stock material from the stack in a direction parallel to the width dimension.

13. A method as set forth in claim 12, where the drawing step is accomplished by one or more rotating members in a conversion machine.

14. A method as set forth in claim 13, where the drawing step includes adjusting a position of one or more pinch rollers adjacent the stack of sheet stock material to vary an amount of sheet stock material passed from the stack to the rotating members.

15. A method as set forth in claim 12, where the drawing step includes drawing sheet stock material from a bottom of the stack.

16. A method as set forth in claim 12, further comprising a step of connecting overlapping layers of sheet stock material.

17. A method as set forth in claim 12, where the providing step includes supporting laterally-spaced portions of the sheet stock material in a plane below an adjacent central portion of the sheet stock material between the laterally-spaced portions.

18. A method as set forth in claim 17, where the supporting step includes progressively supporting the central portion of the sheet stock material at positions further above the plane of the laterally-spaced portions at positions closer to a downstream end of the support.

19. A method as set forth in claim 17, where the supporting step includes supporting the sheet stock material at an angle inclined relative to a horizontal plane, with a downstream end of the stack being higher than an upstream end opposite the downstream end.

20. A method as set forth in claim 12, where the drawing step includes drawing sheet stock material from a top of the stack.

* * * * *